US007720245C1

(12) INTER PARTES REEXAMINATION CERTIFICATE (927th)

United States Patent
Bauman et al.

(10) Number: US 7,720,245 C1
(45) **Certificate Issued: *Aug. 5, 2014**

(54) HEARING AID SYSTEM

(75) Inventors: Natan Bauman, Cheshire, CT (US); Oleg Shikhman, Trumbull, CT (US); Ralph Campagna, Eastford, CT (US)

(73) Assignee: Entrepreneur Growth Capital LLC, New York, NY (US)

Reexamination Request:
No. 95/000,596, Nov. 19, 2010

Reexamination Certificate for:

| | |
|---|---|
| Patent No.: | **7,720,245** |
| Issued: | **May 18, 2010** |
| Appl. No.: | **12/170,574** |
| Filed: | **Jul. 10, 2008** |

( * ) Notice: This patent is subject to a terminal disclaimer.

(51) Int. Cl.
*H04R 25/00* (2006.01)

(52) U.S. Cl.
USPC ..... 381/330; 381/312

(58) Field of Classification Search
None
See application file for complete search history.

(56) References Cited

To view the complete listing of prior art documents cited during the proceeding for Reexamination Control Number 95/000,596, please refer to the USPTO's public Patent Application Information Retrieval (PAIR) system under the Display References tab.

*Primary Examiner* — Scott L Weaver

(57) ABSTRACT

An exemplary hearing aid system includes a receiver unit configured and positioned within the user's ear canal so as to minimize insertion loss and/or occlusion effect.

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-89 are cancelled.

* * * * *

US007720245B2

(12) United States Patent
Bauman et al.

(10) Patent No.: US 7,720,245 B2
(45) **Date of Patent: *May 18, 2010**

(54) HEARING AID SYSTEM

(75) Inventors: Natan Bauman, Cheshire, CT (US); Oleg Shikhman, Trumbull, CT (US); Ralph Campagna, Eastford, CT (US)

(73) Assignee: Auditory Licensing Company, LLC, Westport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/170,574

(22) Filed: Jul. 10, 2008

(65) Prior Publication Data

US 2008/0273733 A1 Nov. 6, 2008

(51) Int. Cl.
*H04R 25/00* (2006.01)

(52) U.S. Cl. ..... 381/330; 381/312

(58) Field of Classification Search ..... 381/312, 381/317, 322, 324, 328, 330, 380, 382, 383; 181/129, 130, 131, 135; 439/8, 17
See application file for complete search history.

(56) References Cited

U.S. PATENT DOCUMENTS

| | | | |
|---|---|---|---|
| 789,876 | A | 5/1905 | Pape |
| 1,830,198 | A | 11/1931 | French |
| 2,363,175 | A | 11/1944 | Grossman |
| 2,930,856 | A | 3/1960 | Toht |
| 3,068,954 | A | 12/1962 | Strzalkowski |
| 3,123,678 | A | 3/1964 | Prentiss et al. |
| 3,581,570 | A | 6/1971 | Wortz |
| 3,688,863 | A | 9/1972 | Johnson |
| 3,764,748 | A | 10/1973 | Branch et al. |
| 3,787,643 | A | 1/1974 | Nielsen |
| 3,890,474 | A | 6/1975 | Glicksberg |
| 4,089,332 | A | 5/1978 | Rose |
| 4,222,393 | A | 9/1980 | Hocks et al. |
| 4,226,248 | A | 10/1980 | Manoli |
| 4,539,440 | A | 9/1985 | Sciarra |
| 4,606,329 | A | 8/1986 | Hough |
| 4,680,798 | A | 7/1987 | Neumann |
| 4,727,582 | A | 2/1988 | de Vries et al. |
| 4,735,968 | A | 4/1988 | Guth |
| 4,759,070 | A | 7/1988 | Voroba et al. |
| 4,830,139 | A | 5/1989 | Cirillo |
| 4,870,688 | A | 9/1989 | Voroba et al. |
| 4,954,486 | A | 9/1990 | Guth |
| 4,956,391 | A | 9/1990 | Sapse |

(Continued)

FOREIGN PATENT DOCUMENTS

| | | |
|---|---|---|
| DE | 3502178 | 8/1985 |

(Continued)

OTHER PUBLICATIONS

Ballachanda, Bopanna B. The Human Ear Canal, 1995, Dingular Publishing Group, Inc. 1st Ed. p. 126.*

(Continued)

*Primary Examiner*—Brian Ensey
(74) *Attorney, Agent, or Firm*—Cantor Colburn LLP

(57) ABSTRACT

An exemplary hearing aid system includes a receiver unit configured and positioned within the user's ear canal so as to minimize insertion loss and/or occlusion effect.

89 Claims, 11 Drawing Sheets

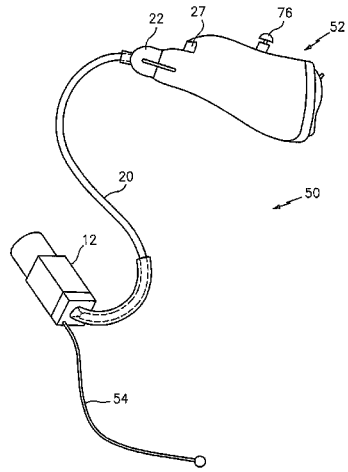

U.S. PATENT DOCUMENTS

| | | | |
|---|---|---|---|
| 4,984,579 | A | 1/1991 | Burgert et al. |
| 5,008,058 | A | 4/1991 | Henneberger et al. |
| 5,024,612 | A | 6/1991 | van den Honert et al. |
| 5,031,219 | A | 7/1991 | Ward et al. |
| 5,064,858 | A | 11/1991 | Sapse |
| 5,167,236 | A | 12/1992 | Junker |
| 5,201,007 | A | 4/1993 | Ward et al. |
| 5,279,292 | A | 1/1994 | Baumann et al. |
| 5,325,782 | A | 7/1994 | Strauss et al. |
| 5,328,330 | A | 7/1994 | Monroe |
| 5,381,484 | A | 1/1995 | Claes et al. |
| 5,403,262 | A | 4/1995 | Gooch |
| 5,420,930 | A | 5/1995 | Shugart, III |
| 5,430,801 | A | 7/1995 | Hill |
| 5,563,140 | A | 10/1996 | Ehrenberger et al. |
| 5,572,594 | A | 11/1996 | Devoe et al. |
| 5,589,183 | A | 12/1996 | Jannetta |
| 5,606,621 | A | 2/1997 | Reiter et al. |
| 5,628,330 | A | 5/1997 | Upham |
| 5,654,530 | A | 8/1997 | Sauer et al. |
| 5,701,348 | A | 12/1997 | Shennib et al. |
| 5,721,783 | A | 2/1998 | Anderson |
| 5,757,935 | A | 5/1998 | Kang et al. |
| 5,920,636 | A | 7/1999 | Oliveira et al. |
| 5,960,093 | A | 9/1999 | Miller |
| 5,979,589 | A | 11/1999 | Aceti |
| 5,987,146 | A | 11/1999 | Pluvinage et al. |
| 6,009,183 | A | 12/1999 | Taenzer et al. |
| 6,021,207 | A | 2/2000 | Puthuff et al. |
| 6,039,685 | A | 3/2000 | Bushek |
| 6,048,305 | A | 4/2000 | Bauman et al. |
| 6,094,492 | A | 7/2000 | Boesen |
| 6,094,493 | A | 7/2000 | Borowsky et al. |
| 6,101,259 | A | 8/2000 | Rapps |
| 6,160,895 | A | 12/2000 | Dupont |
| 6,181,801 | B1 | 1/2001 | Puthuff et al. |
| 6,253,871 | B1 | 7/2001 | Aceti |
| 6,275,596 | B1 | 8/2001 | Fretz et al. |
| 6,320,969 | B1 | 11/2001 | Killion |
| 6,359,993 | B2 | 3/2002 | Brimhall |
| 6,367,578 | B1 | 4/2002 | Shoemaker |
| 6,445,799 | B1 | 9/2002 | Taenzer et al. |
| 6,453,051 | B1 | 9/2002 | Killion |
| 6,473,513 | B1 | 10/2002 | Shennib et al. |
| 6,493,453 | B1 | 12/2002 | Glendon |
| 6,560,468 | B1 | 5/2003 | Boesen |
| 6,600,825 | B1 | 7/2003 | Leysieffer |
| 6,631,196 | B1 | 10/2003 | Taenzer et al. |
| 6,704,423 | B2 | 3/2004 | Anderson et al. |
| 6,724,902 | B1 | 4/2004 | Shennib et al. |
| 6,748,094 | B1 | 6/2004 | Tziviskos et al. |
| 6,804,368 | B2 | 10/2004 | Tsuda |
| 6,914,994 | B1 | 7/2005 | Shennib et al. |
| 7,068,803 | B2 | 6/2006 | Kuhlmann et al. |
| 7,362,875 | B2 | 4/2008 | Saxton et al. |
| 2002/0027996 | A1 | 3/2002 | Leedon et al. |
| 2002/0085728 | A1 | 7/2002 | Shennib et al. |
| 2002/0172386 | A1 | 11/2002 | Bayer |
| 2002/0196958 | A1 | 12/2002 | Halteren et al. |
| 2003/0002700 | A1 | 1/2003 | Fretz et al. |
| 2003/0112992 | A1 | 6/2003 | Rapps |
| 2004/0010181 | A1 | 1/2004 | Feeley et al. |
| 2004/0047483 | A1 | 3/2004 | Bauman |
| 2004/0258263 | A1 | 12/2004 | Saxton et al. |
| 2005/0123146 | A1 | 6/2005 | Voix et al. |

FOREIGN PATENT DOCUMENTS

| | | | |
|---|---|---|---|
| DE | 3508830 | A1 | 9/1986 |
| DE | 87001632 | | 4/1987 |
| DE | 3638747 | C1 | 10/1987 |
| DE | 3625891 | A1 | 2/1988 |
| DE | 29718483 | U1 | 10/1997 |
| DE | 29801567 | U1 | 5/1998 |
| DE | 29718483 | U1 * | 2/1999 |
| EP | 0064042 | A1 | 3/1982 |
| EP | 0158391 | A1 | 10/1985 |
| EP | 0158391 | B1 | 10/1985 |
| EP | 0288822 | | 11/1988 |
| EP | 0695108 | A2 | 1/1996 |
| EP | 1054573 | B1 | 11/2000 |
| FR | 2058156 | A1 | 5/1971 |
| GB | 792742 | | 4/1958 |
| JP | 62151100 | | 7/1987 |
| WO | WO9213430 | | 8/1992 |
| WO | WO9907182 | | 2/1999 |
| WO | WO0001196 | | 1/2000 |
| WO | WO0001199 | | 1/2000 |
| WO | WO0042817 | | 7/2000 |
| WO | WO03015463 | | 2/2003 |
| WO | WO200425990 | | 3/2004 |

OTHER PUBLICATIONS

Knowles Receivers Internet published Web pages, circa Jun. 2002 (Knowles I).*

Taenzer, WO 00/01196, Jan. 6, 2000.*

Re-exam U.S. Appl. No. 95/001,104; filed Nov. 6, 2008.

U.S. Appl. No. 10/325,529, filed Dec. 18, 2002, including submitted evidence of secondary consideration, such as the submitted evidence of Vivatone commercial sales success from 2004-2006, evidence of copying by competitors, and long felt need, as well as the related expert declarations.

U.S. Appl. No. 10/773,731, filed Feb. 5, 2004, including submitted evidence of secondary consideration, such as the submitted evidence of Vivatone commercial sales success from 2004-2006, evidence of copying by competitors, and long felt need, as well as the related expert declarations.

"Lend an Ear," Interview with Natan Bauman by Abram Katz, New Haven Register, Oct. 5, 2003, cited during reexamination U.S. Appl. No. 95/001,104.

Sandlin, Robert E., Ph.D., "Textbook of Hearing Aid Amplification," Second Edition, Singular Publishing Group, Thompson Learing, copyright 2000, cited during reexamination U.S. Appl. No. 95/001,104.

Knowles Receivers Internet published Web pages, circa Jun. 2002, cited during reexamination U.S. Appl. No. 95/001,104.

Knowles FC Series data sheet, cited during reexamination U.S. Appl. No. 95/001,104.

Knowles FK Series Data sheet, cited during reexamination U.S. Appl. No. 95/001,104.

An Innovative Non-occluding DSP Device, cited during reexamination U.S. Appl. No. 95/001,104.

Bruckhoff-apparatebau.com; web page downloaded from Internet Archives, Feb. 6, 2003, cited during reexamination U.S. Appl. No. 95/001,104.

European Search Report—European Application 04708638.4-2002 (5 pg.).

Horakustik Publication Dec. 2002, Bruckhoff & Partner GmbH, Hannover, 4 pages.

English Translation of Portions of the Horakustik Publication, 1 page Dec. 2002.

Court Docket for Civil Docket Case No. 4:07-cv-00212-CVE-SAJ, *Hear-Wear Technologies, LLC* v. *Oticon, Inc.*, et al., 31 pages, date filed Apr. 16, 2007.

Complaint for Civil Docket Case No. 4:07-cv-00212-CVE-SAJ, *Hear-Wear Technologies, LLC* v. *Oticon, Inc.*, et al., 8 pages, date filed Apr. 16, 2007.

Answer and Counterclaim for Civil Docket Case No. 4:07-cv-00212-CVE-SAJ, *Hear-Wear Technologies, LLC* v. *Oticon, Inc.*, et al., 11 pages, date filed Jul. 30, 2007.

Corporate Disclosure Statement for Civil Docket Case No. 4:07-cv-00212-CVE-SAJ, *Hear-Wear Technologies, LLC* v. *Oticon, Inc.*, et al., 5 pages, date filed Jul. 30, 2007.

Answer with Jury Demand for Civil Docket Case No. 4:07-cv-00212-CVE-SAJ, *Hear-Wear Technologies, LLC* v. *Oticon, Inc*., et al., 3 pages, date filed Aug. 9, 2007.
Markman Expert Designation for Civil Docket Case No. 4:07-cv-00212-CVE-SAJ, *Hear-Wear Technologies, LLC* v. *Oticon, Inc*., et al., 3 pages, date filed Jan. 15, 2008.
Rebuttal Markman Expert Designation for Civil Docket Case No. 4:07-cv-00212-CVE-SAJ, *Hear-Wear Technologies, LLC* v. *Oticon, Inc*., et al., 3 pages, date filed Feb. 15, 2008.
Joint Claim Construction Statement for Civil Docket Case No. 4:07-cv-00212-CVE-SAJ, *Hear-Wear Technologies, LLC* v. *Oticon, Inc*., et al., 15 pages, date filed 04/01/08.
*Hear-Wear Technologies, LLC* f/k/a *Hear-Wear, LLC* v. *Dr. Natan Bayman, Nova Hearing Systems, LLC*; and *Hearing, Balance and Speech Center, Inc*.; Complaint and Request for Injunctive Relief; Summonses, Civil Cover Sheet; Appearance of L. Page Heslin for Plaintiff; Order on Pretrial Deadlines, dated Sep. 18, 2003; Notice of Dismissal Without Prejudice; In the United States District Court for the District of Connecticut; Civil Action No. 303cv01599 AWT, dated Nov. 12, 2003.
Knowles Electronics Product Catalog—Standard Receivers [online] Dec. 2006, [retrieved on Dec. 5, 2006] Retrieved from the Knowles Electronics website <URL:http//www.knowleselectronics.com/products/technology.asp?CATEGORY_ID=2 &TECHNOLOGY_ID=5>.
Office Action issued by the Patent Office of the Russian Federation; Application No. 2005127574/28(030952); Filing Date: Oct. 17, 2006; Applicant(s): Vaivatone Hearing Systems, LLC, Dated Feb. 8, 2008.
Hearing Aid Sales Up a Little in '99, The Hearing Journal Mar. 2000 [online], [retrieved on Dec. 6, 2006], Retrieved from Find Articles website<URL:http://www.findarticles.com/p/articles/mi_hb3496/is_200003/ai_n289085>.
Kirkwood, David H., Hearing aid sales slip back to norm, but leaders see growth potential, The Hearing Journal Dec. 2005 [online], [retrieved on Dec. 6, 2006], Retrieved from The Hearing Journal website <URL:http://www.audiologyonline.com/theHearingJournal/pdfs/HJ2005_12pg11-20.pdf.
Phonak Hearing Systems Media Release UHA 2003, "Phonak know-how address Auditory Processing Disorders," Switzerland, p. 1-2.
Phonak Hearing Systems; Field Study News; "EduLink: Improves Speech Understanding in Noisy Classrooms;" May 2004, p. 1-2.
Phonak Hearing Systems; The Hearing Journal, Jul. 2004, vol. 57, No. 7, p. 45.
International Search Report for International Application No. PCT/US04/03449 filed Feb. 5, 2004.
Knowles Electronics Product Catalog—Standard Receivers [online], [retrieved on Dec. 5, 2006] Retrieved from the Knowles Electronics website <URL:http//www.knowleselectronics.com/products/technology.asp?CATEGORY_ID=2&TECHNOLOGY_ID=5>.
Shepherd, N.L., Heading to the Beginning, Hearing Products Report Jul. 2006 [online], [retrieved on Dec. 5, 2006] Retrieved from Hearing Products Report website <URL:http://www.hearingproductsreport.com/article.php?s=HPR/2006/07&p=3>.
GN Magazine Jan. 2005 [online], [retrieved on Dec. 7, 2006] Retrieved from GN websiite <URL:http://www.gn.com/var/gn.storage/original/application/ea22f38e4dbfc9fcb0e3cc77e0d7088d.pdf.>.
ReSoundAiR presentation notes/pamphlet (in Danish) Sep. 8, 2003 [pnline], [retrieved on Dec. 6, 2006], Retrieved from GN website <URL:http//www.gn.com/var/gn/storage/original/application/phpG5vgnN.pdf>.
An Innovative Non-Occluding DSP Device, GN ReSound article created Apr. 2003 [online], [retrieved on Dec. 6, 2006], Retrieved from GN ReSound website <URL:http://www.openfitting.com/2903-gb-03.02.pdf>.
International Search Report for International Application No. PCT/US03/39960 filed Dec. 16, 2003.
U.S. Appl. No. 10/325,529 Decision on Appeal dated Feb. 27, 2009.
U.S. Appl. No. 95/001,104 Order Granting Request for Inter Partes Reexamination of U.S. Patent No. 7,421,086 dated Jan. 27, 2009.
U.S. Appl. No. 95/001,104 Office Action in Inter Partes Reexamination dated Mar. 19, 2009.
Effect of Ear Canal Occlusion on Pure-Tone Threshold Sensitivity, J. Am Acac Audio 16:740-746 (2005).
Hearing Aid Handbook, pp. 186-195, TAB Books (1978).
A Comprehensive Dictionary, definition of "Non-Occluding Mold" The Hearing Aid Journal (1973).
Markku Toivonen, et al., Noise Attenuation and Proper Insertion of Earplugs into Ear Canals, Ann. occup. Hyg., vol. 46, No. 6, pp. 527-530, 2202, 4 pages.
Knowles Electronics Product Catalog—Standard Receivers [online], [retrieved on Dec. 5, 2006] retrieved from the Knowles Electronics website <URL:http://www.knowleselectronics.com/products/technology.asp? CATEGORY_ID=2&TECHNOLOGY_ID=5>, 4 pages.
Knowles FC Series data sheet (Knowles II) (2001), cited during reexamination U.S. Appl. No. 95/001,104, 4 pages.
Morgan, N.B., et al., "Taking the art out of smart!—Forming processes and durability issues for the application of NiTi shape memory alloys in medical devices," Proceedings from the Materials and Processes for Medical Devices Conference, Sep. 8-10, 2003, Anaheim, CA, 6 pages.
Nova hearing aid, Interview by Medical Reporter Jocelyn Maminta with Natan Bauman, appeared on WTNH-TV Channel 8 on Jun. 30, 2003 (retrieved from "http://www.hearingbalance.com/uploads/Nova.WMV" on Jul. 29, 2009.
"Introducing the Nova" Dr. Natan Bauman, The Hearing Balance & Speech Center (www.hearingbalance.com), Jul. 1, 2003 (retrieved from: http://web.archive.org/web/20030701041351/http://www.hearingbalance.com on Aug. 7, 2009).
Wikipedia, "Nickel Titanium" Oct. 6, 2009, [citedJul. 29, 2009] available from: [http://en.wikipedia.org/wiki/Nickel_titanium].
Wikipedia, "Shape memory alloy" Jun. 28, 2009, [cited Jul. 29, 2009] available from: [http://en.wikipedia.org/wiki/Shape_memory_alloy].
Carsten, Daugaard, Delta "Insertion loss and occlusion effect measured on open fit hearing aid" Technical Note, Oct. 21, 2008.
Affidavit of Henning Bruckhoff dated Nov. 27, 2008.
Affidavit and Declaration of Doug Erickson dated Sep. 29, 2008 and Jul. 25, 2008.
Notice of Opposition Documents_047086384/1590988, filed Aug. 2009.
Partial Translation of Appeal Brief filed on Jan. 13, 2009, JP4006470B.
Notification of First Office Action dated May 8, 2009, 2004800055634 China.
Reexam 95001104_Requester Comments and Thompson Declaration filed Jan. 6, 2010.

* cited by examiner

HEARING AID SYSTEM

CROSS REFERENCE TO RELATED APPLICATIONS

The present application claims priority to U.S. patent application Ser. No. 10/241,279, filed Sep. 10, 2002, U.S. patent application Ser. No. 10/325,529, filed Dec. 18, 2002, U.S. Provisional Patent Application No. 60/445,034, filed Feb. 5, 2003, U.S. Provisional Patent Application No. 60/514,994, filed Oct. 27, 2003, U.S. patent application Ser. No. 10/773,731, filed Feb. 5, 2004, U.S. Provisional Patent Application No. 60/535,569, filed Jan. 9, 2004, and U.S. patent application Ser. No. 11/331,842, filed Jan. 13, 2006, the entire contents of each of which are specifically incorporated herein by reference.

BACKGROUND

A wide variety of hearing aid instruments are known in the art. Most hearing aids, worn in the ear (ITE) or behind the ear (BTE) occlude to some degree the ear canal, causing an occlusion loss. Occlusion loss is described as a difference between performance of an open ear response (REUR—real ear unaided response) and the performance of an ear with a hearing aid in place but turned off (REAR—real ear aided response with hearing aid turned off). Therefore, placing a hearing aid in the ear eliminates the natural ability of the patient's concha and the ear canal to produce a resonance between, e.g., 2000 and 4000 Hz (hertz), which naturally increases sounds entering the ear. This important feature allows human ear to better understand speech information. The average enhancement is about 16 to 20 dB. It can be clearly seen that a loss of 16 to 20 dB (loss of REUR) in addition to a loss due to a mechanical structure of the hearing aid can create a significant occlusion loss of sometimes up to 40 dB at frequencies between 2000 and 4000 Hz. This presently described hearing aid is configured to eliminate and/or significantly reduce such loss (terms "occlusion loss" and "insertion loss" when a hearing aid is inserted into an ear but turned off are used interchangeably).

Also, most hearing aids—either ITE or BTE—positioned within the ear canal create an occlusion effect. That is, the occlusion effect is associated with the sensation or feeling that the patient's head is "at the bottom of the barrel," with the patient's own voice becoming intolerably loud. This is often related to a patient's rejection of the amplification due to the patient's discomfort with the patient's own voice.

Placing an earmold or a shell of a custom made hearing aid within the ear canal can produce a low frequency amplification of the patient's voice of between about 10 and 20 decibels. This can relate to a perceived loudness increase in the patient's own voice of about four times the actual loudness of the patient's voice.

Accordingly, there remains a need in the art for a hearing aid that avoids the occlusion loss and occlusion effect problems described above.

SUMMARY

The above-discussed and other drawbacks and deficiencies of the prior art are overcome or alleviated by the presently described hearing aid system, including a receiver unit configured and positioned within the user's ear canal so as to minimize insertion loss and/or occlusion effect. As may be understood from below, the receiver unit minimizes insertion loss and occlusion effects by positioning the receiver in the acoustically open ear canal, meaning that the positioned receiver generates about 8 decibels (dB) or below of insertion loss and occlusion effect over human audible frequencies. This new and unique positioning of a speaker (or receiver or receiver unit as used herein, which receiver unit need not necessarily include, e.g., additional electronic, amplification, processing, etc. aspects apart from the speaker itself) also provides improved characteristics of sound delivery into a hearing impaired ear.

In another embodiment, such receiver unit creates an insertion loss over the audible range of human hearing below about eight decibels.

In another embodiment, a micro-receiver unit is positioned in an open-ear configuration within the ear canal of a user, and a sound processing unit positioned behind the pinna is linked to the micro-receiver unit. The described hearing aid advantageously reduces the insertion loss and occlusion effect.

In one exemplary embodiment, the receiver unit has a maximum lateral dimension Ø. Such dimension describes the maximum overall dimension or diameter (though it is not to be implied that the cross section of the receiver unit must be circular or oval or any other geometric shape) of the receiver unit. In one exemplary embodiment, the receiver unit has a dimension Ø that is less than the maximum lateral dimension or diameter of the user's ear canal. In another embodiment, the receiver unit has a dimension Ø that is less than half the maximum lateral dimension or diameter of the user's ear canal. In another embodiment, the receiver unit has a dimension Ø that is less than twenty percent of the maximum lateral dimension or diameter of the user's ear canal. In another embodiment, the receiver unit has a dimension Ø that is less than ten percent of the maximum lateral dimension or diameter of the user's ear canal. In another embodiment, the receiver unit has a dimension Ø that is less than five percent of the maximum lateral dimension or diameter of the user's ear canal.

In another exemplary embodiment, the hearing aid comprises a sound processing unit, a receiver unit, and an intermediate connecting portion between the sound processing unit and the receiver unit, wherein the intermediate connecting portion comprises an electrical conducting component and a stiffening wire, provided on at least a portion of the intermediate connecting portion. The stiffening wire may comprise any material that provides stiffness to the intermediate connecting portion, e.g., metal, plastic or the like. Additionally, the conducting wire may also serve as the stiffening wire. In an exemplary embodiment, the stiffening wire comprises a stainless steel wire. In another exemplary embodiment, the stiffening wire comprises a metal or alloy of metals having memory such that the wire may deflect and return to an original orientation. Such may be stainless steel, among others. Such may also be a shape memory alloy.

In another exemplary embodiment, the stiffening wire is provided within or on a portion of the intermediate connecting portion and extends within or on at least a portion of the receiver unit. In such embodiment, the receiver unit is positioned on the intermediate connecting portion with greater stability and resiliency. Also where a stiffening element is used, the intermediate connecting portion and receiver unit may be custom manufactured or custom molded to optimize positioning of the receiver unit within the ear canal and/or to optimize positioning of the intermediate connecting portion.

In another embodiment, a retaining wire extends from one of the stiffening wire and the receiver unit. The retaining wire is configured to position within a portion of the concha of the ear. In such embodiment, the retaining wire may be configured to prevent excessive insertion of the hearing aid receiver unit into the ear canal. Also, the retaining wire may be configured to cause the hearing aid receiver unit to be suspended within a portion of the ear canal, such that no portion of the receiver unit touches the sides of the ear canal.

In another embodiment, the electrical conducting component comprises two wires within distinct channels or otherwise isolated from one another within the intermediate connecting portion. In another embodiment, a stiffening element is provided within or on the intermediate connecting portion within a distinct channel or otherwise isolated from the wires.

In another embodiment, the receiver unit comprises a speaker, at least partially enclosed within a casing having first and second end portions, the first end portion communicating with the intermediate connecting portion, the speaker communicating with a port provided at the second end portion of the casing. In another embodiment, the casing is sealed to fluids at the first end portion and along a length of the casing extending from the first end portion to the port provided at the second end portion. The port may also be sealed to fluids by a membrane or mesh material.

The above-discussed and other features and advantages of the present invention will be appreciated and understood by those skilled in the art from the following detailed description and drawings.

BRIEF DESCRIPTION OF THE DRAWINGS

Referring now to the exemplary drawings wherein like elements are numbered alike in the several FIGURES.

DETAILED DESCRIPTION

Figure 1:
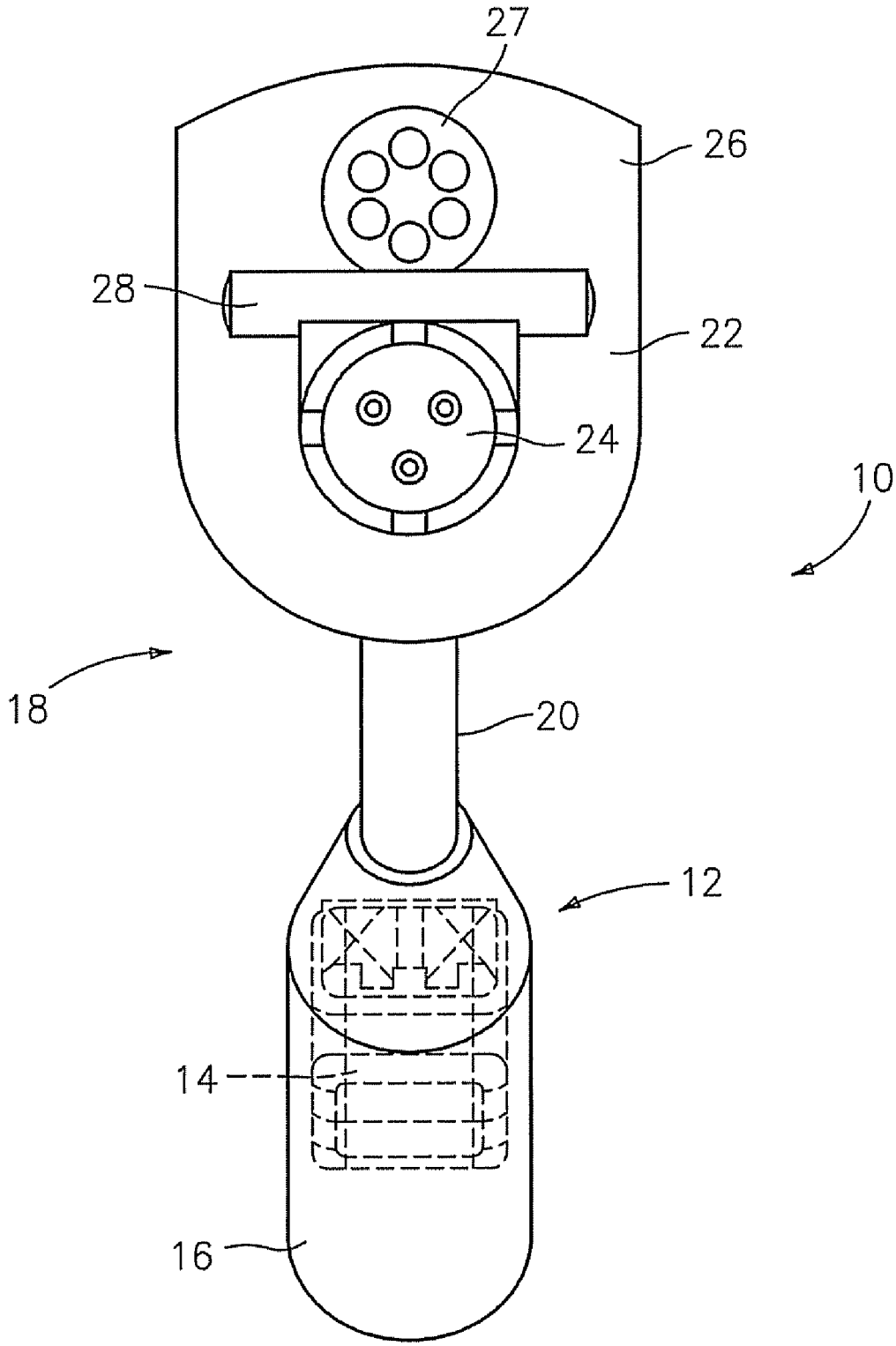
FIG. 1 is a diagrammatic view of an exemplary receiver unit, intermediate connecting portion and sound processing component connector for a hearing aid system.

Referring now to FIG. 1, an exemplary receiver unit and connection portion is illustrated generally at 10 for the presently described hearing aid system. In one exemplary embodiment, the hearing aid system is configured as a completely open canal (COC) or totally open canal (TOC) system. With reference to FIG. 1, the illustrated exemplary receiver unit portion, shown generally at 12, includes a speaker 14 that is at least partially surrounded by a casing 16. The receiver unit portion 12 is attached to a connection portion, shown generally at 18, which includes an intermediate connecting portion 20 and a sound processing component connector 22. The sound processing unit connector 22 includes an electrical interface 24 configured to mate with a corresponding electrical interface (not illustrated) on the sound processing unit. The illustrated electrical interface 24 is a three-pin female interface, surrounded by a connector shell 26. While shell 26 is illustrated as a two part shell joined by lock pin 28, it should be recognized that shell 26 may take any convenient configuration, or the interface 24 may simply comprise the electrical interface 24 such that the shell 26 is of minimal profile or is eliminated. Optionally, a microphone 27 may be provided in the shell 26. The microphone 27 may be connected to the sound-processing unit through an additional electrical connection (not shown) or through the electrical interface 24.

Figure 2:
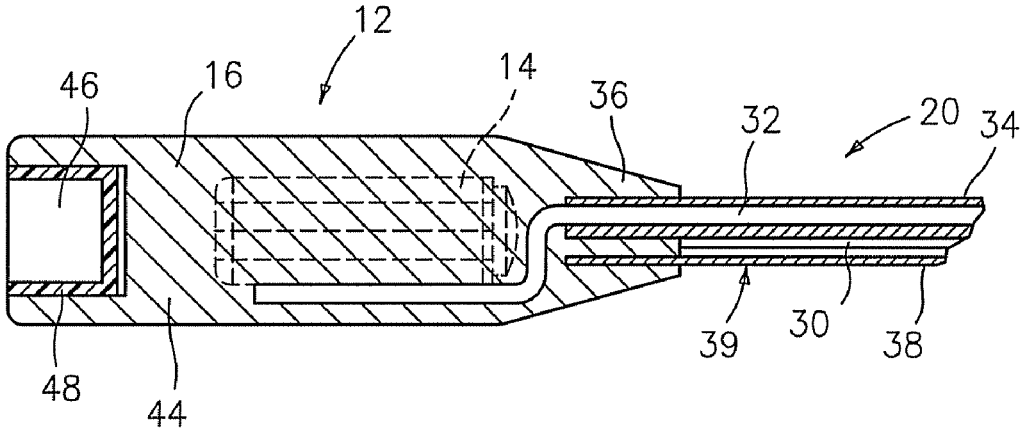
FIG. 2 is a cross sectional view of an exemplary receiver unit and intermediate connecting portion.

Referring now to FIG. 2, the exemplary receiver unit 12 and intermediate connecting portion 20 are illustrated in greater detail. The speaker 14 is illustrated as being at least partially enclosed within the casing 16. The illustrated exemplary intermediate connecting portion 20 comprises an electrical conducting component 30 and a stiffening wire 32, provided along at least a portion of the intermediate connecting portion 20. In another exemplary embodiment, the stiffening wire 32 comprises a stainless steel wire. In another exemplary embodiment, the stiffening wire 32 comprises a metal or alloy of metals having memory such that the wire may deflect and return to an original orientation. For example, the stiffening wire 32 may be a shape memory alloy.

Referring again to FIG. 2, the illustrated exemplary stiffening wire 32 is provided within or on a portion of the intermediate connecting portion 20 and extends within or on at least a portion of the receiver unit 12. The stiffening wire 32 in the illustrated exemplary embodiment extends through a channel 34 in the intermediate connecting portion 20, into a proximal portion 36 of the receiver unit 12 and alongside the speaker 14. In such embodiment, and indeed whenever the stiffening wire is used in or on any portion of the receiver unit 12 and the intermediate connecting portion 20, the receiver unit 12 may be positioned relative to the intermediate connecting portion 20 with greater stability and resiliency. Also where a stiffening wire 32 is used, the intermediate connecting portion 20 and receiver unit 12 may be custom manufactured or custom molded (e.g., shaped by heat) to optimize positioning of the receiver unit 12 within the ear canal and/or to optimize positioning of the intermediate connecting portion 20.

While stiffening of the intermediate connecting portion 20 is described above with regard to a stiffening wire, it is to be recognized that alternate stiffening mechanisms are contemplated. For example, any material of the intermediate connecting portion 20 may comprise a stiff material, including the material of the conductor. Additionally, the stiffening wire may comprise any material that provides stiffness to the intermediate connecting portion, e.g., metal, plastic or the like. Such material may have memory properties or not. In one exemplary embodiment, an outer tube 39 of the intermediate connecting portion comprises a stiff material. In one exemplary embodiment, tube 39 comprises a stainless steel wire. In another exemplary embodiment, the tube 39 comprises a metal or alloy of metals having memory such that the wire may deflect and return to an original orientation. For example, the tube 39 may be a shape memory alloy.

Figure 8:
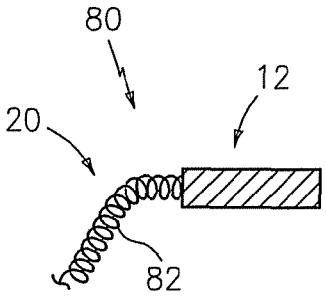
FIG. 8 is a side view of an exemplary stiffened intermediate connecting portion.

Referring now to FIG. 8, another exemplary stiffening arrangement for the intermediate connecting portion 20 is illustrated generally at 80. In such embodiment, the intermediate connecting portion 20 comprises a goose neck material 82. In such embodiment, the goose neck material 82 may be a goose neck tube provided over or in place of outer tube 39 (shown in FIG. 2). As with the above stiffening embodiments, the receiver unit 12 may be positioned relative to the intermediate connecting portion 20 with greater stability and resiliency. Also, the intermediate connecting portion 20 and receiver unit 12 may be custom manufactured or custom molded to optimize positioning of the receiver unit 12 within the ear canal and/or to optimize positioning of the intermediate connecting portion 20.

Figure 9:
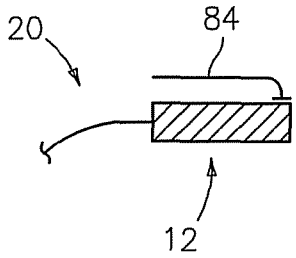
FIG. 9 is a side view of an exemplary receiver unit positioning mechanism.
Figure 10:
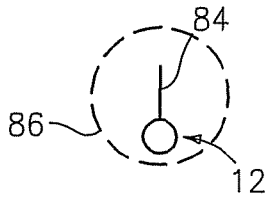
FIG. 10 is a front view of the exemplary mechanism of FIG. 9.

Referring now to FIGS. 8-16 and 19-22, various other exemplary mechanisms facilitating positioning of the receiver unit 12 in the ear canal are illustrated. With regard to FIGS. 9 and 10, at least one spring 84 is provided on a portion of the receiver unit 12. As illustrated in FIG. 10, when the receiver unit 12 is installed within the ear canal 86, the spring 84 may contact a wall of the ear canal 86 to facilitate positioning of the receiver unit 12 within the ear canal 86. Also, multiple springs 84 can be positioned for receiver unit 12 placement inside the ear canal. Such at least one spring 84 may be positioned anywhere on the receiver unit 12, or indeed, on a portion of the intermediate connecting portion 20 provided within the ear canal 86.

Figure 19:
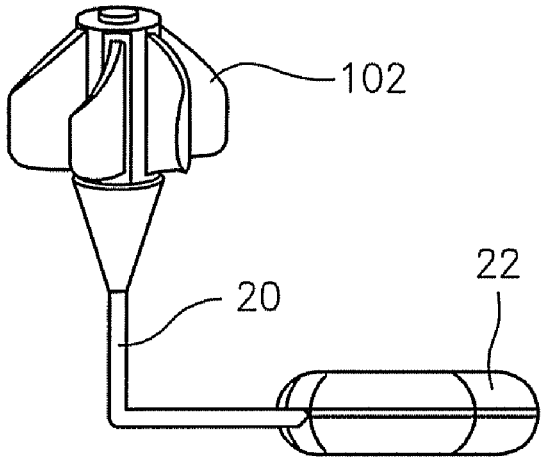
FIG. 19 is a an elevation view of an exemplary receiver unit including a plurality of fin supports.
Figure 20:
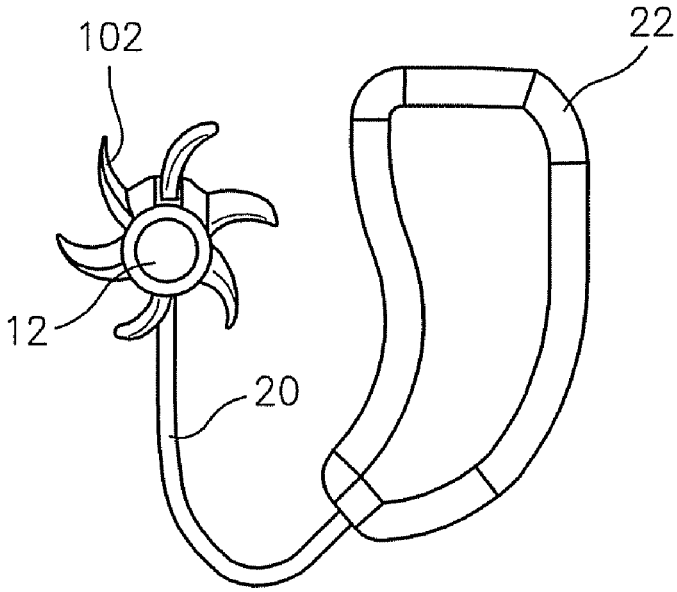
FIG. 20 is a perspective view of the exemplary embodiment illustrated in FIG. 19.

Referring to FIGS. 19-20, one or more fins 102 may be provided around the hearing aid receiver unit 12, which fins 102 are used to space the receiver unit 12 from at least one wall portion of the ear canal. In the illustrated exemplary embodiment, six fins are provided around the circumference of a cross section of the receiver unit 12. In another exemplary embodiment, the fins are compliant, such that they will elastically deform within the ear canal to adjust for cross-sectional area differences within the ear canal and to increase comfort for the wearer.

Figure 21:
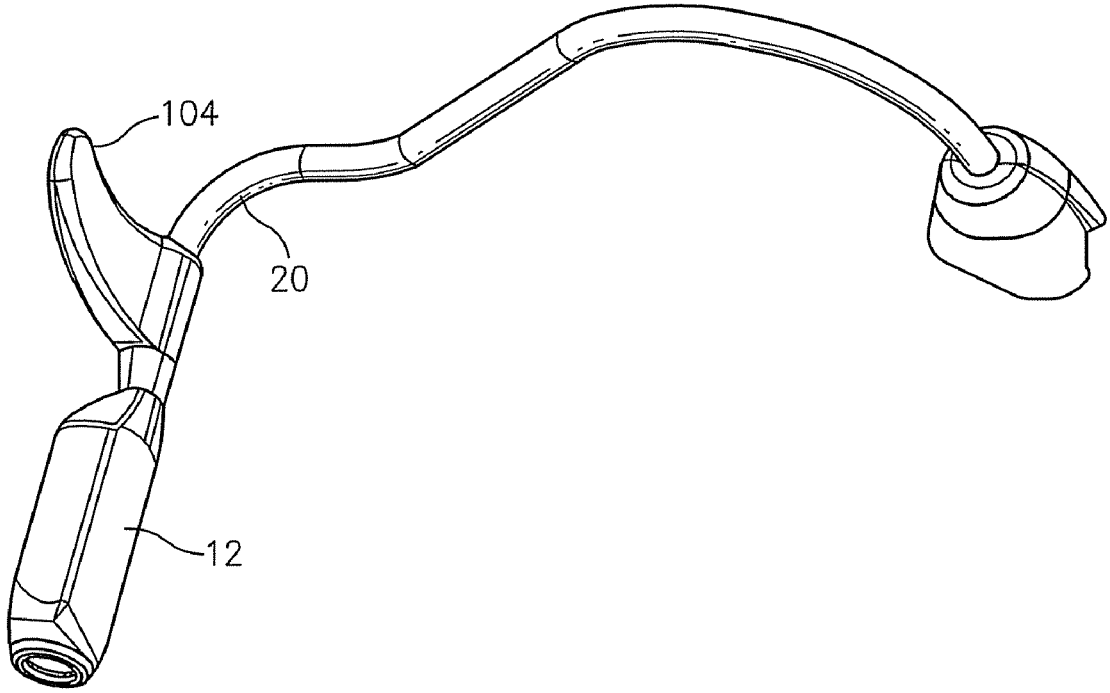
FIG. 21 is a perspective view of an exemplary receiver unit and intermediate connecting portion including a tragus fin.

Referring now to FIG. 21, another exemplary embodiment illustrates a fin 104 projecting from a portion of the intermediate connecting portion 20 rather than being provided on the receiver unit 12. In an exemplary embodiment, such fin may be strategically positioned to set insertion depth of the receiver unit 12 and/or space the receiver unit from a portion of the user's ear canal by configuring such fin such that a portion of the fin will contact the tragus of a user. Such fin may also be a compliant material, where increased comfort is a concern. While one fin is illustrated in the exemplary embodiment, one or more fins or the like are contemplated.

Figure 22:
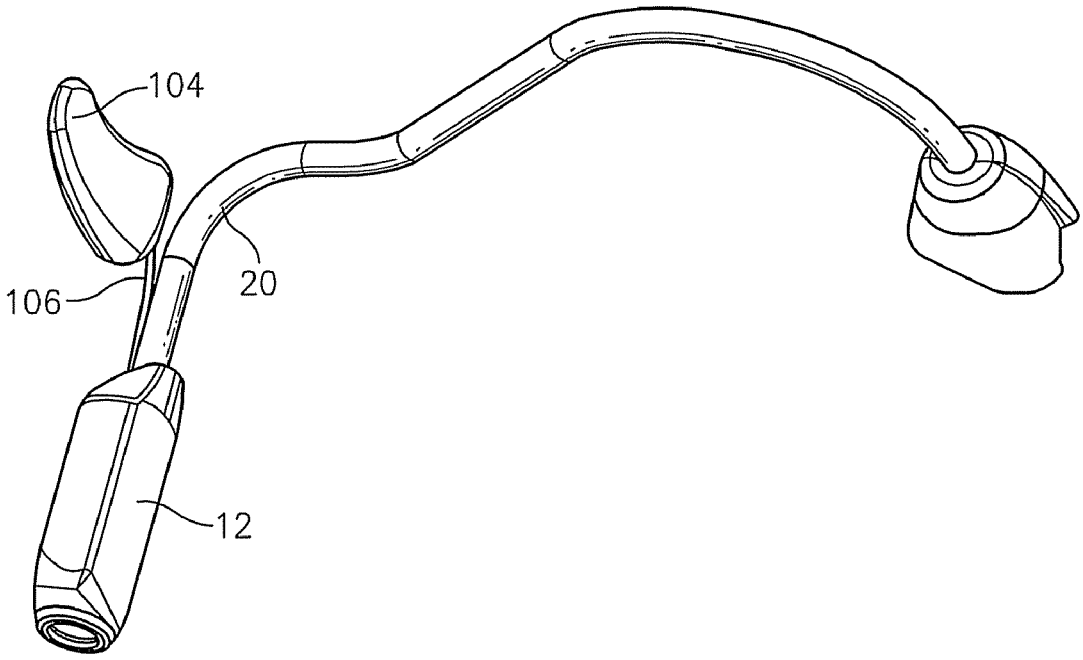
FIG. 22 is a perspective view of an exemplary receiver unit and intermediate connecting portion including a tragus fin provided on a spring material.

Referring now to FIG. 22, another exemplary embodiment illustrates a fin 104, provided on a spring material 106, which spring material 106 depends from a portion of the receiver unit 12. As above with regard to FIG. 21, such fin may be strategically positioned to set insertion depth of the receiver unit 12 and/or space the receiver unit from a portion of the user's ear canal by configuring such fin such that a portion of the fin will contact the tragus of a user. Such fin may also be a compliant material, where increased comfort is a concern. Also, the spring material 106, upon which the fin is positioned, may depend from the intermediate connecting portion 20 rather than from the receiver unit 12. While one fin is illustrated in the exemplary embodiment, one or more fins or the like are contemplated.

Figure 11:
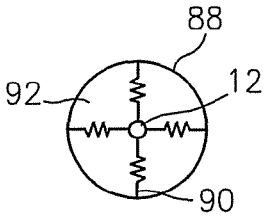
FIG. 11 is a front view of another exemplary receiver unit positioning mechanism.
Figure 12:
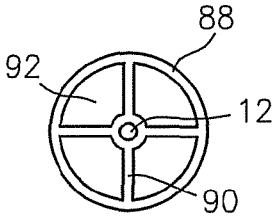
FIG. 12 is a front view of another exemplary receiver unit positioning mechanism.
Figure 13:
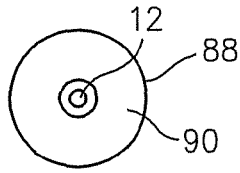
FIG. 13 is a front view of another exemplary receiver unit positioning mechanism.

Referring now to FIGS. 11-13, various structures having surfaces remote from the hearing aid receiver unit and having one or more apertures permitting passage of sound there through may also be utilized to facilitate positioning of the hearing aid receiver unit within an ear canal. FIGS. 11-13 illustrate exemplary configurations, wherein the receiver unit 12 is supported within a ring of material 88 by one or more supports 90. As illustrated by FIG. 11, such support 90 may comprise a spring or spring material. As illustrated by FIG. 12, such support 90 may be a non-spring support provided with or adjacent to one or more apertures 92 in the illustrated cross section.

Also as illustrated by FIG. 13, such support 90 may be a porous material, which may act as a sound transmission filter, preventing sounds generated within the ear canal from escaping by altering the sounds (for feedback reduction). Additionally, the porous material may reduce direct transmission of sound into the ear canal. However, such material would not significantly increase any occlusion effect, since the material would be generally transparent to low frequency human hearing range sounds that are mainly responsible for the occlusion effect when trapped within the ear canal. The filtering properties of such material may be varied as a function of density and pore size of the material 90. Such material 90 may comprise any material having porosity, including but not limited to, paper tissue, Teflon coated fiber, perforated silicone, and membrane. Again, it is recognized that such materials may be used as long as the receiver maintains an acoustically open ear canal, meaning that the positioned receiver generates about 8 decibels (dB) or below of insertion loss and occlusion effect over human audible frequencies.

In the exemplary embodiments described by FIGS. 11-13, the at least one support 90 may be rigid. Such support 90 may also be deformable. Such support may also comprises a material having memory such that the support may deflect and return to an original orientation. Additionally, the ring 88 may also be rigid. Such ring 88 may also be deformable. Such ring may also comprises a material having memory such that the support may deflect and return to an original orientation. Also, though the above embodiments describe a ring 88, any configuration providing a supported surface away from the receiver unit 12 is contemplated. There may be one supported surface (a ring or other desired geometry) or a plurality of supported surfaces (a broken ring or independent surfaces). These configurations may also decrease the amount of sound escaping from or entering the ear canal.

Figure 14:
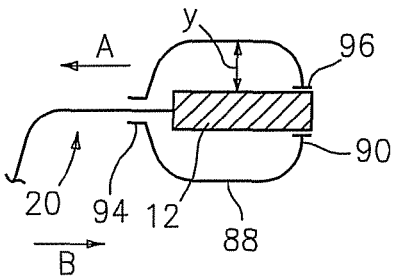
FIG. 14 is a side view of an exemplary adjustable receiver unit positioning mechanism.
Figure 15:
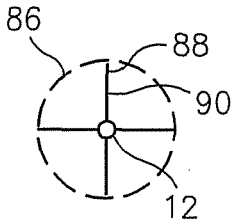
FIG. 15 is a front view of the exemplary mechanism of FIG. 14.
Figure 16:
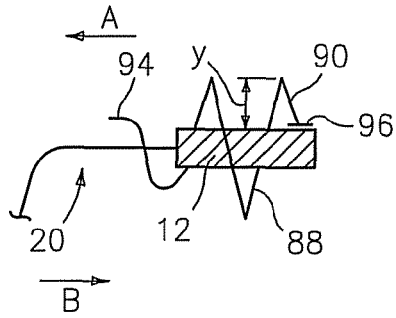
FIG. 16 is a side view of another exemplary adjustable receiver unit positioning mechanism.

Referring now to FIGS. 14-16, adjustable support surfaces may also be provided on the receiver unit 12 and/or on the intermediate connecting portion 20. In the illustrated exemplary configurations, the distance $\gamma$ from an outer surface of the receiver unit 12 and the outer surface of the supported surface 88 may be varied. By movement of actuation portion 94 in the direction of arrow A, supported surface 88 will be drawn closer to the receiver unit 12, and the distance γ will be reduced. By movement of actuation portion 94 in the direction of arrow B, supported surface 88 will be pushed away from the receiver unit 12, and the distance γ will be increased. In the illustrated embodiments, the support 90 is adhered or otherwise attached to the receiver unit at 96.

While material of the supported surface 88 should be rigid enough to retain some supported configuration, it is contemplated, in one embodiment, that such supported surface 88 be able to bend around contours of the ear canal. Supported surface 88 and support 90 may comprise the same material or have the same properties (resilience, thickness, etc.), or they may comprise different materials or have different properties. Additionally, where the material properties of the supported surface 88 and/or support 90 do not tend to hold position when the actuation portion 94 is adjusted along direction lines A or B, the actuation portion 94 may be configured to frictionally engage, hold or lock against the intermediate connecting portion 20.

Referring again to FIG. 2, the illustrated electrical conducting component 30 is provided within a channel 38 within the intermediate connecting portion 20. The electrical conducting component 30 extends from the speaker 14 through the intermediate connecting component 20 to the electrical interface 24 to provide electrical connection between the sound processing unit and the speaker 14.

Figure 3:
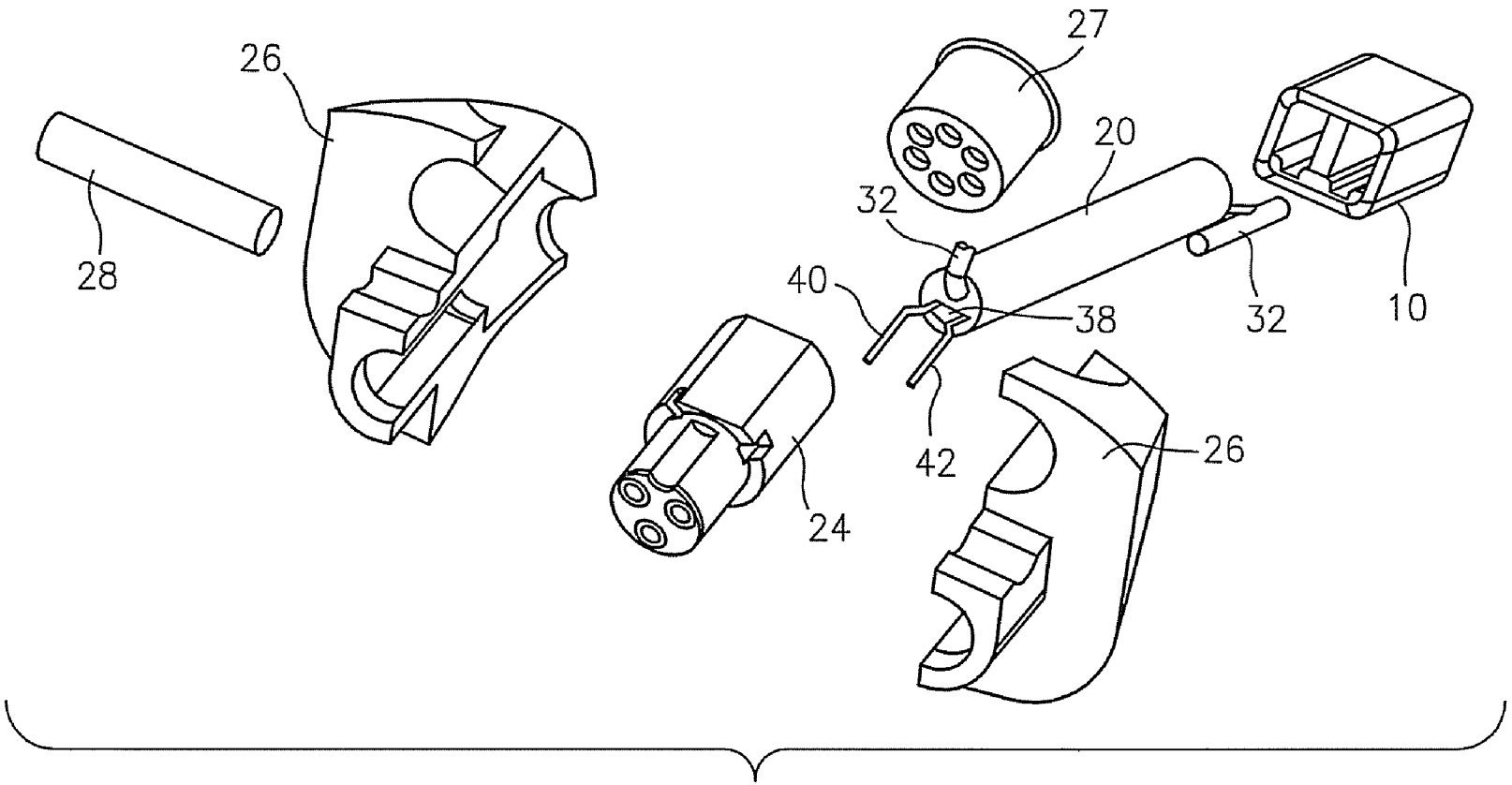
FIG. 3 is an expanded plan view of an exemplary receiver unit, intermediate connecting portion and sound processing component connector for a hearing aid system.

With reference to FIG. 3, in an exemplary embodiment, the electrical conducting component 30 comprises two wires 40, 42 provided within channel 38. While this embodiment illustrates both wires 40, 42 provided within the same channel 38, it is to be recognized that alternative configurations are contemplated. For example, both wires 40, 42 may share the same channel as the stiffening wire 32. Also, each wire 40, 42 may be provided within distinct channels or may be otherwise isolated from one another within the connection.

Referring again to FIG. 2, the illustrated exemplary receiver unit casing has first (proximal) 36 and second (distal) 44 end portions, the first end portion communicating with the intermediate connecting portion 20, the speaker 14 communicating with a port 46 provided at the second end portion 44 of the casing 16. As described by the illustrated exemplary embodiment, the casing is provided around the speaker from the intermediate connecting portion 20 to the port 46. Where non-permeable materials are used for the casing 16, the casing 16 is sealed to fluids at the first end portion 36 and along a length of the casing 16 extending from the first end portion 36 to the port 46 provided at the second end portion 44. As illustrated, the port 46 may itself be sealed to fluids by a membrane or mesh material 48. The materials used for the casing may be formed in any number of manners, including as a two shell assembly, as an overmold, or as a shrinkwrap. Any material may be used. In one exemplary embodiment, the material is a polypropylene. In another embodiment, the material is a nylon or polyethylene. The port may also be provided with a permanent or removable cerumen collection device.

Referring again to FIG. 2, the receiver unit has a maximum lateral dimension Ø. Such dimension describes the maximum overall dimension or diameter (though it is not to be implied that the cross section of the receiver unit must be circular or oval or any other geometric shape) of the receiver unit 16. In one exemplary embodiment, the receiver unit has a dimension Ø that is less than the maximum lateral dimension or diameter of the user's ear canal. In another exemplary embodiment, the receiver unit has a dimension Ø that is less than half the maximum lateral dimension or diameter of the user's ear canal. In another embodiment, the receiver unit has a dimension Ø that is less than twenty percent of the maximum lateral dimension or diameter of the user's ear canal. In another embodiment, the receiver unit has a dimension Ø that is less than ten percent of the maximum lateral dimension or diameter of the user s ear canal. In another embodiment, the receiver unit has a dimension Ø that is less than five percent of the maximum lateral dimension or diameter of the user's ear canal.

Figure 18:
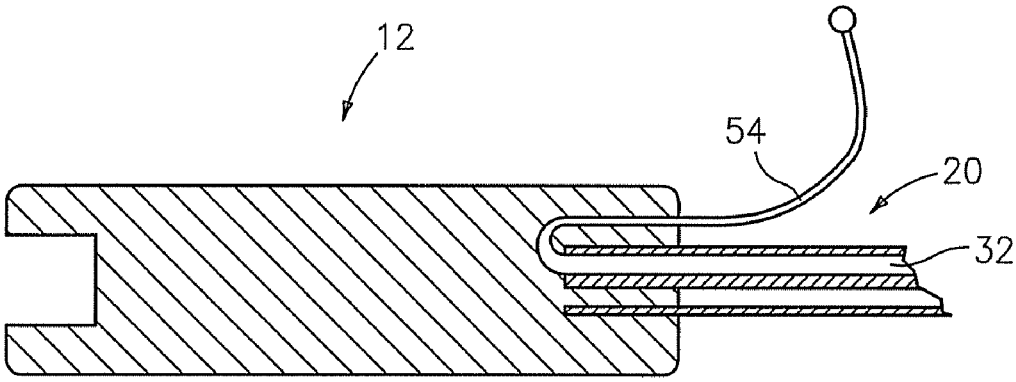
FIG. 18 is a cross sectional view of an exemplary receiver unit and intermediate connecting portion having a combination stiffening and retaining wire.
Figure 4:
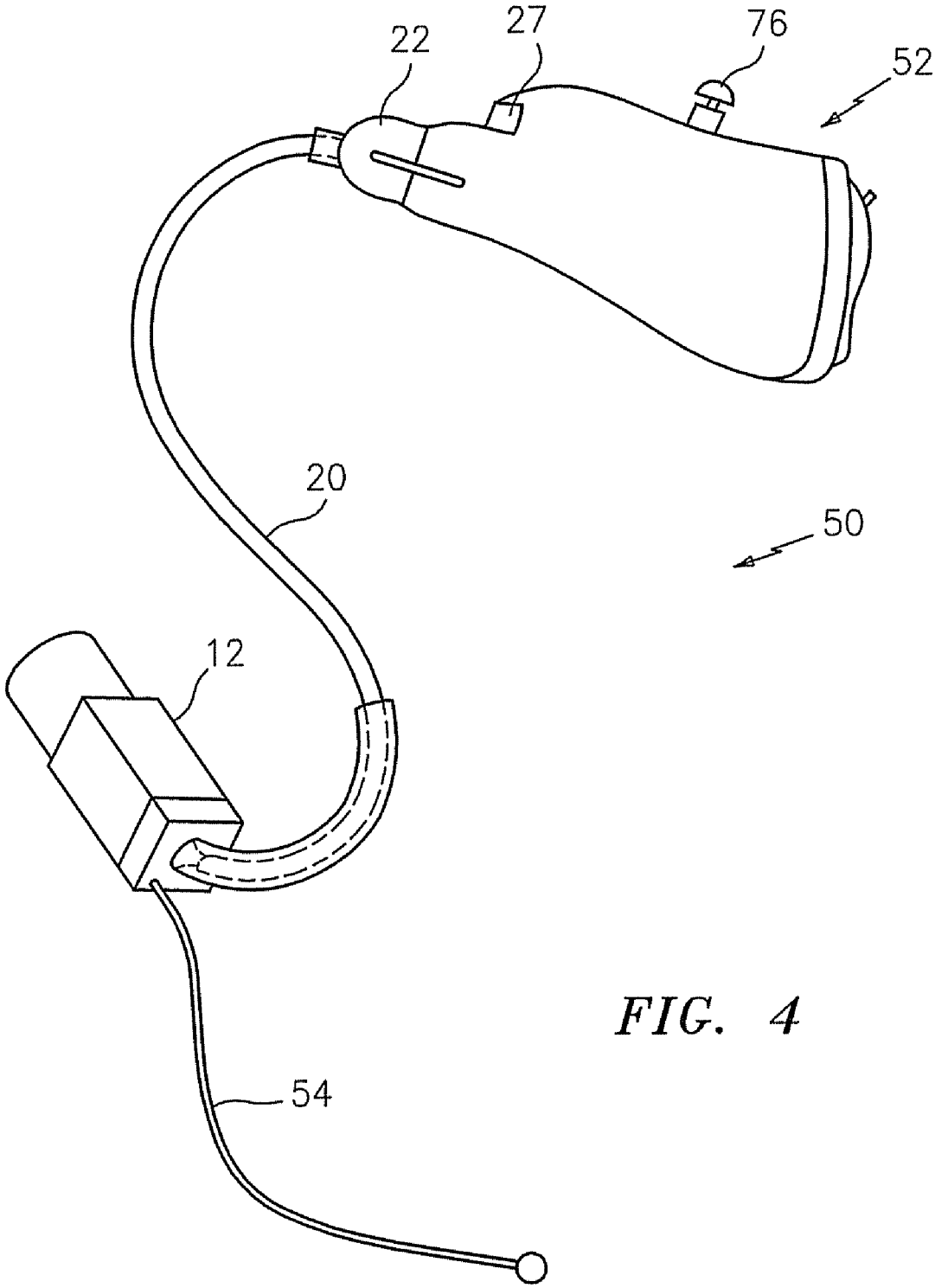
FIG. 4 is a plan view of an exemplary assembled hearing aid system including a retaining wire.
Figure 5:
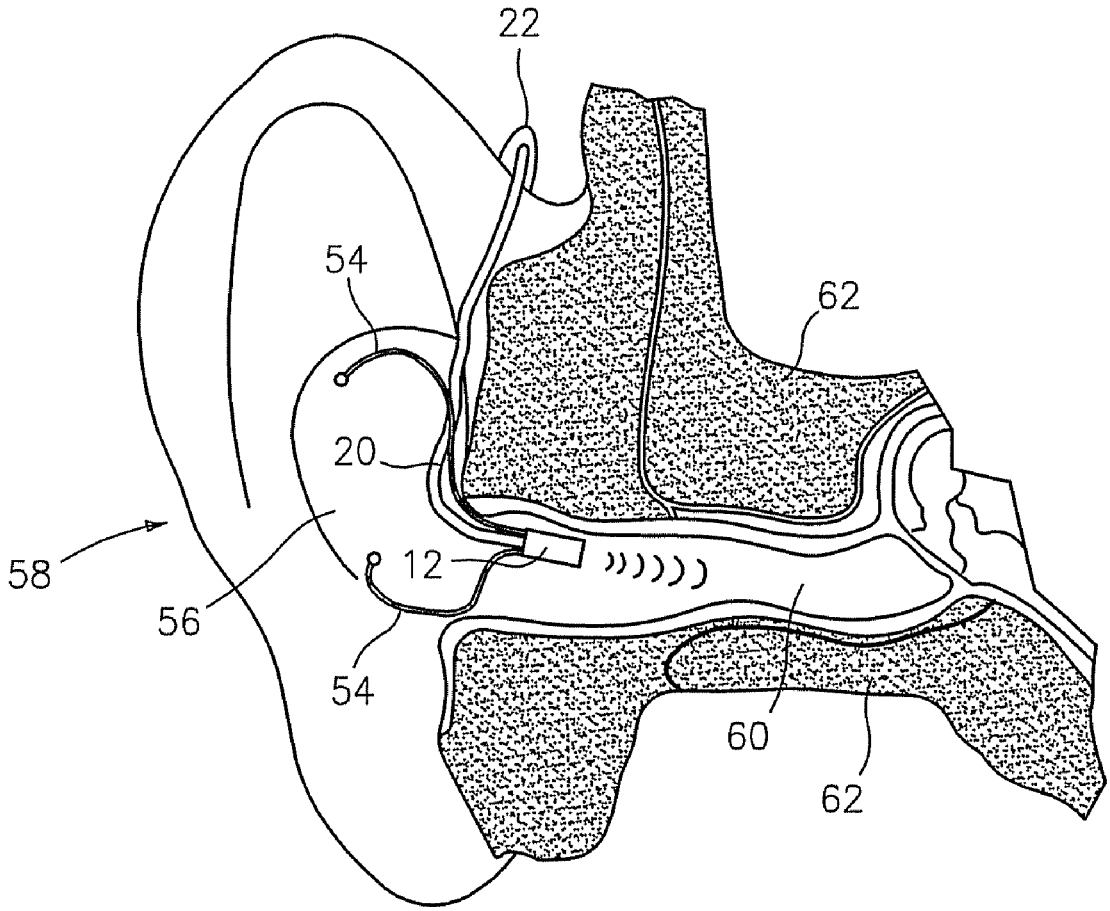
FIG. 5 is a cutaway view of a user's ear with the hearing aid system installed.

Referring now to FIG. 4, a second exemplary hearing aid system is illustrated generally at 50. The receiver unit 12, intermediate connecting portion 20 and sound processing unit 52 are illustrated in assembled form. Sound processing component connector 22 is illustrated as joined with the sound processing unit 52. As illustrated, an exemplary retaining wire 54 extends from the receiver unit 12. As illustrated by FIG. 5, the retaining wire 54 is configured to position within a portion of the concha 56 of the ear, shown generally at 58 (however, it should be noted that the retaining wire may be configured to contact any portion of the external ear). In such embodiment, the retaining wire 54 may be configured to define an exemplary maximum insertion of the hearing aid receiver unit 12 into the ear canal 60. For example, the configuration of the retaining wire 54, receiver unit 12 and intermediate connecting portion 20 may be such that the receiver unit extends into the ear canal, but not into the bony regions 62 of the ear canal 60 (though it should be recognized that such receiver unit may be positioned anywhere within the ear canal, including within the bony regions). In another exemplary embodiment, one or more additional retaining wires 54 may be utilized. Also, as illustrated in FIG. 5, the retaining wire 54 may be configured to cause the hearing aid receiver unit 12 to be suspended within a portion of the ear canal 60, such that no portion of the receiver unit touches the sides of the ear canal 60. While the retaining wire 54 is illustrated as extending from the receiver unit 12, it should be recognized that the retaining wire 54 may also or alternatively extend from the intermediate connecting portion 20. For example, FIG. 18 illustrates a configuration wherein the retaining wire 54 additionally acts as a stiffening wire 32 for the intermediate connecting portion 20.

Figure 6:
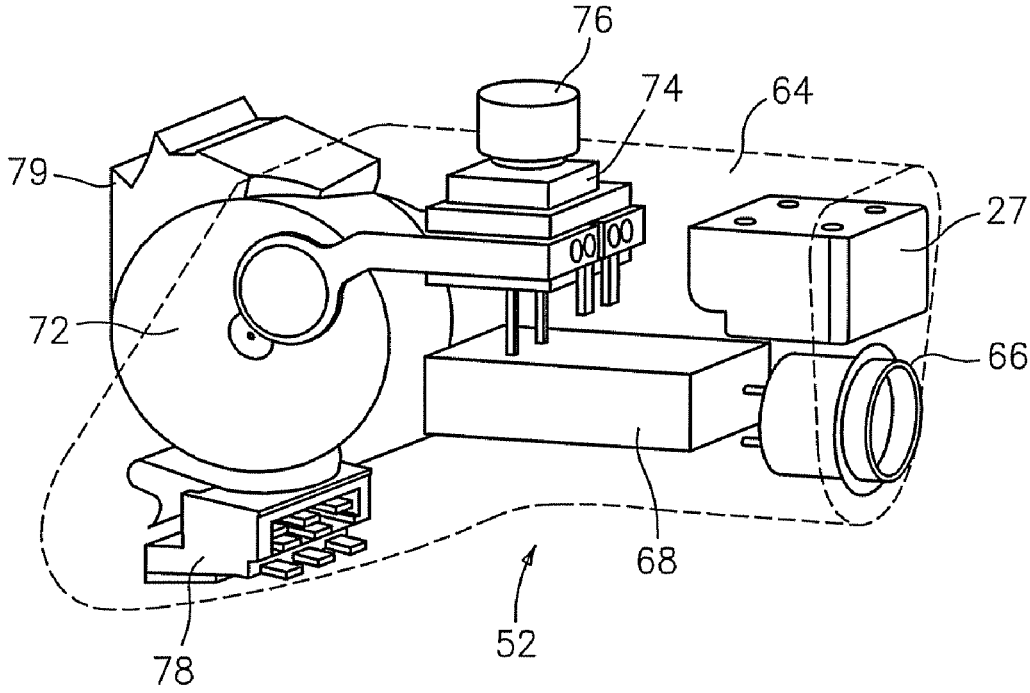
FIG. 6 is a plan view of an exemplary sound processing unit.
Figure 17:
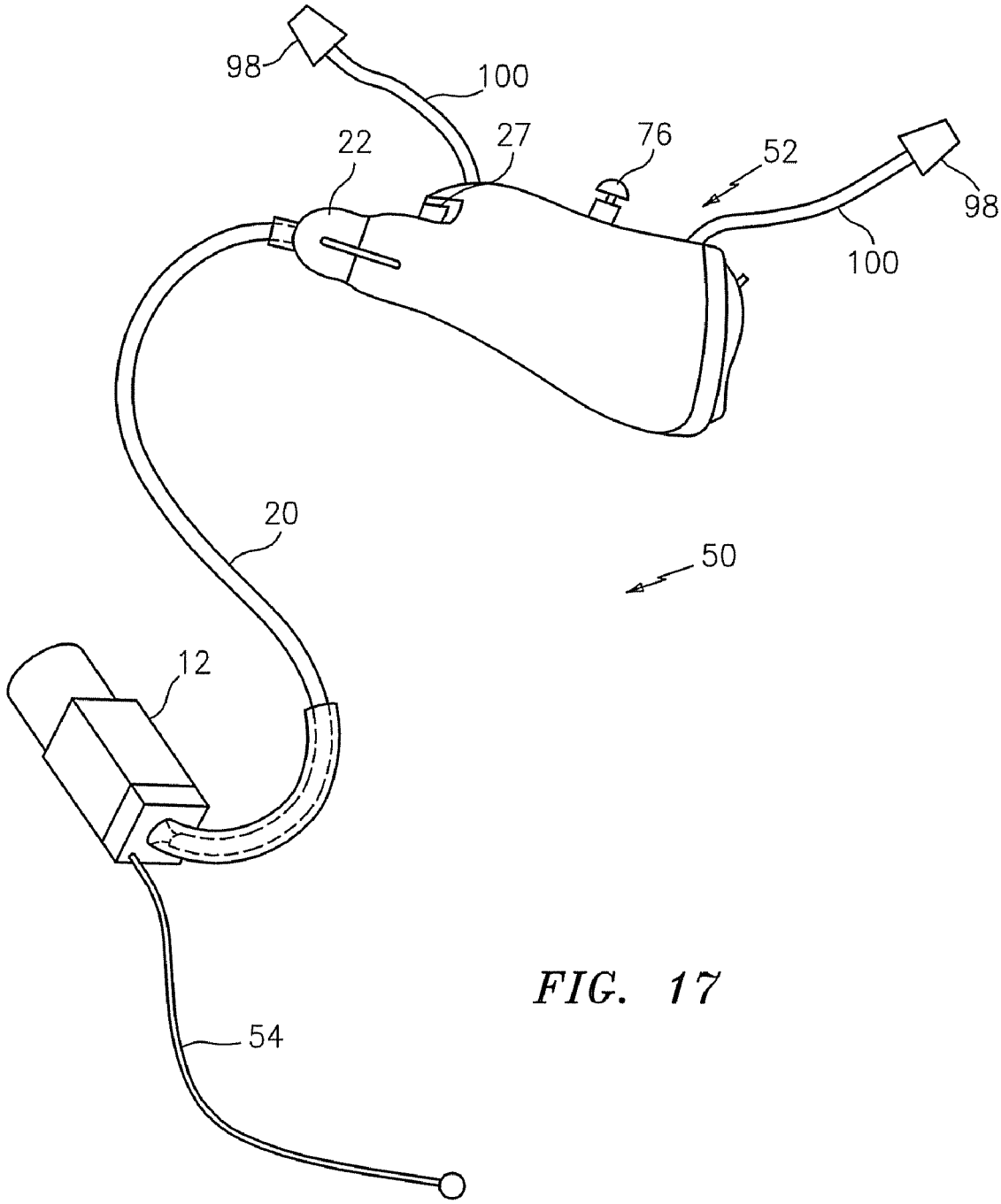
FIG. 17 is a side view of an exemplary hearing aid system with external microphones.

Referring now to FIG. 6, an exemplary sound processing unit (SPU) is illustrated generally at 52. The illustrated SPU 52 generally includes: a housing 64; an SPU electrical interface 66, which is illustrated as a male three-pin electrical connection, connected to an amplifier and sound processing component 68; a microphone 27 connected to the amplifier and sound processing component 68; a battery component 72 providing power to the amplifier and sound processing component 68; a switch component 74, illustrated with a push button 76 for providing a user interface with the amplifier and sound processing component 68 and/or the battery component 72; and a programming connector 78 configured to permit external programming and reprogramming of the SPU and/or to permit expansion of the hearing aid device with additional internal components. A programming connection switch 79 may be provided to permit a hearing professional or user to control programming or reprogramming of the amplifier and sound processing component 68. Additionally, an input port (not shown) may be provided proximate thereto (or indeed, anywhere on the device) to effect programming or reprogramming of the device from an external source. Memory storage may be provided within the amplifier and sound processing component 68 and/or anywhere within the device to permit such programming and reprogramming of the SPU and/or to permit a user to select various programs via the user interface. Also, as illustrated by the exemplary embodiment of FIG. 17, at least one additional microphone 98 may be provided (e.g., mounted on a goose neck type assembly 100) external to the SPU 52 in addition to or in lieu of microphone 27.

Figure 7:
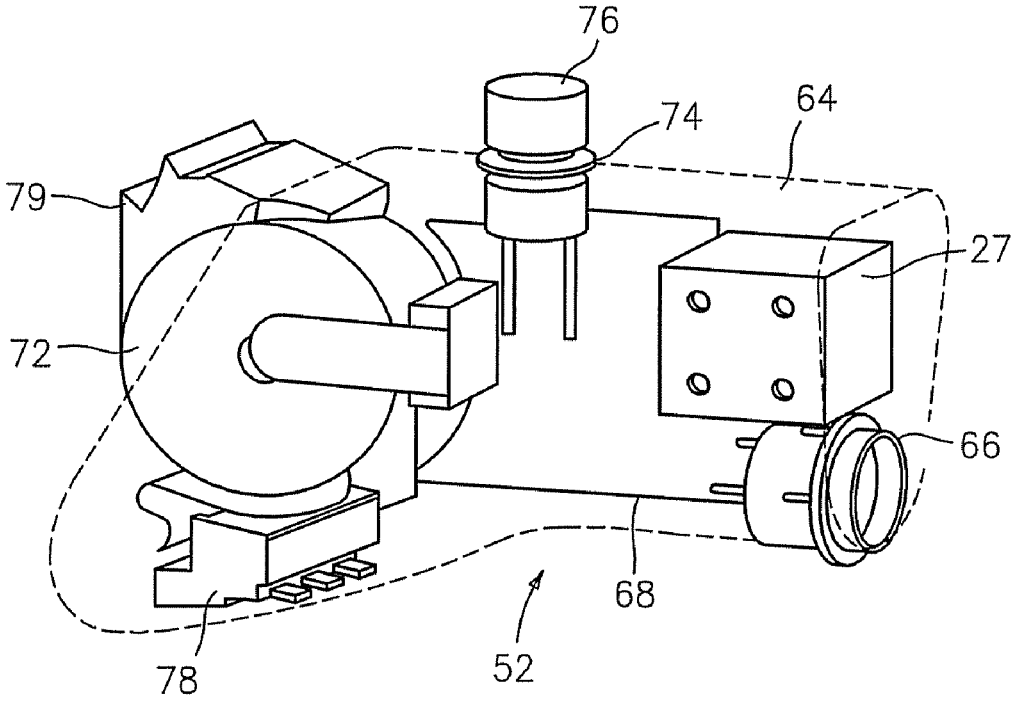
FIG. 7 is a plan view of another exemplary sound processing unit.

FIG. 7 illustrates a second exemplary SPU configuration, wherein the amplifier and sound processing component 68 is provided as a circuit board interconnecting each of the battery component 72, the switch component 74, the microphone 27 and the SPU electrical interface 66.

EXAMPLE

The following TABLES summarize the data collected by analysis of the presently disclosed open ear hearing device (V=Vivatone) along with three additional hearing devices (G=General Hearing Instruments (GHI), O=Oticon, and S=Sebotek) on twelve subjects (Group A).

For purposes of Group A testing, the Vivatone Device was configured in an open ear configuration with a receiver unit size of 0.149 inches (in). It is to be recognized that while the tested Group A Vivatone receiver unit had a maximum lateral dimension of 0.149 in, any receiver unit size facilitating an open ear configuration is contemplated (as discussed in the above Summary and above within the Detailed Description).

The tested General Hearing Instruments was a canal-open-ear (COE) Auris™ hearing aid. The tested Oticon Device was a low profile, Open Ear Acoustics™ configuration per Oticon. The tested Sebotek Device was the PAC (Post Auricular Canal) hearing aid also described by U.S. Pat. No. 5,606,621 to Reiter, the entire contents of which are specifically incorporated herein by reference.

An additional twelve subjects (Group B) participated in an evaluation of six Vivatone hearing devices with different size receiver unit modules (None (nothing in the ear), V=0.149 in, 1=0.170 in, 2=0.190 in, 3=0.210 in, 4=0.230 in).

The analyzed data includes the measurements from the Probe Real Ear Insertion Response Curve, which consisted of differences between the Probe Real Ear Unaided Response Curve (for measurements of insertion loss) and the Probe Real Ear Aided Response Curve and the corresponding values repeated while the subject vocalized the letter "EE" (for measurement of occlusion effect). We call the first two differences the Insertion Response (or insertion loss) and the last two differences the Occlusion Effect. Values are given at 79 frequencies (200 Hz to 8000 Hz at increments of 100 Hz).

Analysis of variance models were run for each frequency. Comparisons are adjusted for Subject variability and Order of Test. Repeated observations for each subject were not included in the analysis of variance since the variability from the repeated tests was quite small. All calculations were carried using the R software package.

Comparison results are given in the below TABLES 1-12. Results are given for each frequency. TABLE 1 provides estimates and standard errors of the Insertion Response for the evaluated hearing devices tested with Group A. TABLE 2 provides comparisons of each non-Vivatone Group A device to the Vivatone device. Positive values indicate that the Insertion Loss was greater for the non-Vivatone device. Negative values indicate that the Insertion Loss was greater for the Vivatone device. Simply stated, the smaller the Insertion Loss, the least effect inserting a hearing aid has on changing the natural characteristics of the ear. For example, an insertion loss of −8 dB means that the ear lost 8 dB of sounds in comparison to an unaided ear. T-values equal to or greater than 2.47 are statistically significant (adjusting for multiple comparisons). TABLES 1-2 follow:

TABLE 1

Insertion Gain Estimates

| frequency | G: est | SE | O: est | SE | S: est | SE | V: est | SE |
|---|---|---|---|---|---|---|---|---|
| 200 | 0.48 | 0.75 | 0.54 | 0.75 | −2.97 | 0.73 | 0.23 | 0.74 |
| 300 | 0.58 | 0.84 | 0.86 | 0.84 | −3.52 | 0.82 | 0.26 | 0.83 |
| 400 | 0.68 | 1.00 | 1.47 | 1.00 | −4.45 | 0.98 | 0.25 | 0.99 |
| 500 | 0.83 | 1.08 | 2.06 | 1.09 | −5.36 | 1.07 | 0.20 | 1.08 |
| 600 | 0.93 | 1.15 | 2.45 | 1.16 | −6.45 | 1.13 | 0.23 | 1.14 |
| 700 | 1.13 | 1.20 | 2.45 | 1.21 | −7.89 | 1.19 | 0.28 | 1.20 |
| 800 | 1.33 | 1.24 | 1.95 | 1.25 | −9.51 | 1.22 | 0.43 | 1.23 |
| 900 | 1.54 | 1.26 | 1.12 | 1.27 | −10.89 | 1.24 | 0.54 | 1.25 |
| 1000 | 1.64 | 1.23 | 0.13 | 1.24 | −11.75 | 1.21 | 0.63 | 1.22 |
| 1100 | 1.84 | 1.24 | −0.87 | 1.25 | −12.83 | 1.22 | 0.67 | 1.23 |
| 1200 | 1.99 | 1.29 | −1.94 | 1.29 | −14.00 | 1.27 | 0.60 | 1.27 |
| 1300 | 2.02 | 1.29 | −2.84 | 1.30 | −14.96 | 1.27 | 0.54 | 1.28 |
| 1400 | 2.12 | 1.28 | −3.78 | 1.29 | −15.75 | 1.26 | 0.57 | 1.27 |
| 1500 | 2.12 | 1.23 | −4.79 | 1.24 | −16.59 | 1.21 | 0.53 | 1.22 |
| 1600 | 2.14 | 1.28 | −5.96 | 1.29 | −17.82 | 1.26 | 0.54 | 1.27 |
| 1700 | 1.97 | 1.18 | −7.19 | 1.19 | −18.72 | 1.16 | 0.51 | 1.17 |
| 1800 | 1.63 | 1.10 | −8.68 | 1.11 | −19.67 | 1.09 | 0.53 | 1.09 |
| 1900 | 1.03 | 0.99 | −10.35 | 1.00 | −20.51 | 0.98 | 0.61 | 0.98 |
| 2000 | −0.01 | 0.97 | −12.13 | 0.97 | −21.87 | 0.95 | 0.62 | 0.96 |
| 2100 | −1.17 | 0.94 | −13.96 | 0.95 | −23.21 | 0.93 | 0.53 | 0.93 |
| 2200 | −2.66 | 0.92 | −15.69 | 0.92 | −24.51 | 0.90 | 0.25 | 0.91 |
| 2300 | −4.22 | 0.88 | −17.37 | 0.89 | −25.84 | 0.87 | −0.24 | 0.88 |
| 2400 | −5.85 | 0.83 | −18.81 | 0.84 | −26.85 | 0.82 | −0.80 | 0.83 |
| 2500 | −7.30 | 0.77 | −19.94 | 0.78 | −27.59 | 0.76 | −1.40 | 0.76 |
| 2600 | −8.39 | 0.75 | −20.63 | 0.75 | −27.92 | 0.74 | −1.92 | 0.74 |
| 2700 | −9.08 | 0.72 | −20.98 | 0.72 | −27.86 | 0.71 | −2.32 | 0.71 |
| 2800 | −9.55 | 0.70 | −21.01 | 0.70 | −27.60 | 0.69 | −2.52 | 0.69 |
| 2900 | −9.64 | 0.70 | −20.85 | 0.71 | −27.03 | 0.69 | −2.55 | 0.69 |
| 3000 | −9.57 | 0.71 | −20.52 | 0.72 | −26.41 | 0.70 | −2.38 | 0.71 |
| 3100 | −9.34 | 0.73 | −20.10 | 0.73 | −25.73 | 0.71 | −2.33 | 0.72 |
| 3200 | −9.23 | 0.72 | −19.75 | 0.73 | −25.12 | 0.71 | −2.23 | 0.71 |
| 3300 | −9.09 | 0.74 | −19.45 | 0.74 | −24.61 | 0.73 | −2.12 | 0.73 |
| 3400 | −8.94 | 0.76 | −19.14 | 0.77 | −24.06 | 0.75 | −2.07 | 0.76 |
| 3500 | −8.86 | 0.80 | −18.91 | 0.80 | −23.83 | 0.78 | −2.06 | 0.79 |
| 3600 | −8.79 | 0.81 | −18.82 | 0.82 | −23.56 | 0.80 | −2.02 | 0.80 |
| 3700 | −8.79 | 0.81 | −18.77 | 0.82 | −23.56 | 0.80 | −2.02 | 0.81 |
| 3800 | −8.84 | 0.83 | −18.87 | 0.83 | −23.65 | 0.81 | −2.02 | 0.82 |
| 3900 | −8.82 | 0.85 | −18.93 | 0.86 | −23.82 | 0.84 | −2.07 | 0.84 |
| 4000 | −8.79 | 0.89 | −19.00 | 0.89 | −23.79 | 0.87 | −2.00 | 0.88 |
| 4100 | −8.80 | 0.89 | −19.15 | 0.90 | −23.75 | 0.88 | −1.96 | 0.88 |
| 4200 | −8.84 | 0.89 | −19.35 | 0.90 | −23.60 | 0.88 | −1.99 | 0.88 |
| 4300 | −8.89 | 0.92 | −19.46 | 0.93 | −23.43 | 0.91 | −2.00 | 0.92 |
| 4400 | −8.97 | 0.92 | −19.53 | 0.93 | −23.21 | 0.91 | −1.95 | 0.91 |
| 4500 | −9.12 | 0.90 | −19.69 | 0.91 | −22.83 | 0.89 | −1.96 | 0.90 |
| 4600 | −9.32 | 0.90 | −19.79 | 0.91 | −22.38 | 0.89 | −1.84 | 0.89 |
| 4700 | −9.58 | 0.84 | −19.82 | 0.85 | −21.96 | 0.83 | −1.81 | 0.83 |
| 4800 | −9.82 | 0.84 | −19.82 | 0.85 | −21.76 | 0.83 | −1.76 | 0.84 |

TABLE 2

Insertion Gain Comparisons

| frequency | G vs V est | SE | t-value | O vs V est | SE | t-value | S vs V est | SE | t-value |
|---|---|---|---|---|---|---|---|---|---|
| 200 | 0.25 | 1.06 | 0.24 | 0.30 | 1.06 | 0.29 | −3.20 | 1.05 | −3.05 |
| 300 | 0.32 | 1.19 | 0.27 | 0.60 | 1.19 | 0.50 | −3.78 | 1.18 | −3.21 |
| 400 | 0.43 | 1.41 | 0.30 | 1.22 | 1.42 | 0.86 | −4.70 | 1.40 | −3.35 |

TABLE 2-continued

| | Insertion Gain Comparisons | | | | | | | | |
|---|---|---|---|---|---|---|---|---|---|
| frequency | G vs V est | SE | t-value | O vs V est | SE | t-value | S vs V est | SE | t-value |
| 500 | 0.63 | 1.54 | 0.41 | 1.86 | 1.54 | 1.20 | −5.57 | 1.53 | −3.65 |
| 600 | 0.70 | 1.63 | 0.43 | 2.22 | 1.63 | 1.36 | −6.68 | 1.61 | −4.14 |
| 700 | 0.85 | 1.71 | 0.50 | 2.17 | 1.72 | 1.26 | −8.17 | 1.70 | −4.82 |
| 800 | 0.90 | 1.76 | 0.51 | 1.52 | 1.77 | 0.86 | −9.95 | 1.75 | −5.69 |
| 900 | 1.00 | 1.78 | 0.56 | 0.58 | 1.79 | 0.32 | −11.43 | 1.77 | −6.47 |
| 1000 | 1.01 | 1.74 | 0.58 | −0.50 | 1.75 | −0.28 | −12.38 | 1.73 | −7.16 |
| 1100 | 1.18 | 1.76 | 0.67 | −1.54 | 1.76 | −0.87 | −13.50 | 1.74 | −7.74 |
| 1200 | 1.39 | 1.82 | 0.76 | −2.53 | 1.83 | −1.38 | −14.60 | 1.81 | −8.07 |
| 1300 | 1.48 | 1.83 | 0.81 | −3.38 | 1.84 | −1.84 | −15.51 | 1.82 | −8.54 |
| 1400 | 1.55 | 1.81 | 0.86 | −4.35 | 1.82 | −2.39 | −16.32 | 1.80 | −9.07 |
| 1500 | 1.59 | 1.74 | 0.91 | −5.32 | 1.75 | −3.04 | −17.11 | 1.73 | −9.90 |
| 1600 | 1.60 | 1.82 | 0.88 | −6.50 | 1.82 | −3.56 | −18.37 | 1.80 | −10.19 |
| 1700 | 1.46 | 1.67 | 0.88 | −7.70 | 1.68 | −4.59 | −19.23 | 1.66 | −11.60 |
| 1800 | 1.09 | 1.56 | 0.70 | −9.22 | 1.57 | −5.87 | −20.21 | 1.55 | −13.02 |
| 1900 | 0.42 | 1.41 | 0.30 | −10.96 | 1.41 | −7.76 | −21.12 | 1.40 | −15.13 |
| 2000 | −0.63 | 1.37 | −0.46 | −12.75 | 1.38 | −9.27 | −22.49 | 1.36 | −16.53 |
| 2100 | −1.70 | 1.33 | −1.28 | −14.49 | 1.34 | −10.81 | −23.74 | 1.32 | −17.92 |
| 2200 | −2.91 | 1.30 | −2.24 | −15.94 | 1.30 | −12.23 | −24.76 | 1.29 | −19.22 |
| 2300 | −3.98 | 1.25 | −3.17 | −17.13 | 1.26 | −13.60 | −25.59 | 1.25 | −20.55 |
| 2400 | −5.05 | 1.18 | −4.26 | −18.01 | 1.19 | −15.16 | −26.05 | 1.17 | −22.18 |
| 2500 | −5.89 | 1.09 | −5.39 | −18.53 | 1.10 | −16.90 | −26.19 | 1.08 | −24.14 |
| 2600 | −6.47 | 1.06 | −6.09 | −18.71 | 1.07 | −17.54 | −26.00 | 1.05 | −24.66 |
| 2700 | −6.77 | 1.02 | −6.63 | −18.67 | 1.02 | −18.23 | −25.55 | 1.01 | −25.23 |
| 2800 | −7.02 | 0.99 | −7.09 | −18.49 | 0.99 | −18.58 | −25.08 | 0.98 | −25.49 |
| 2900 | −7.09 | 0.99 | −7.15 | −18.31 | 1.00 | −18.37 | −24.48 | 0.99 | −24.85 |
| 3000 | −7.18 | 1.01 | −7.09 | −18.13 | 1.02 | −17.83 | −24.03 | 1.01 | −23.90 |
| 3100 | −7.01 | 1.03 | −6.81 | −17.77 | 1.03 | −17.21 | −23.40 | 1.02 | −22.91 |
| 3200 | −7.00 | 1.02 | −6.86 | −17.52 | 1.02 | −17.10 | −22.89 | 1.01 | −22.59 |
| 3300 | −6.97 | 1.05 | −6.65 | −17.32 | 1.05 | −16.48 | −22.49 | 1.04 | −21.63 |
| 3400 | −6.88 | 1.08 | −6.35 | −17.08 | 1.09 | −15.71 | −22.00 | 1.07 | −20.47 |
| 3500 | −6.81 | 1.13 | −6.04 | −16.85 | 1.13 | −14.89 | −21.77 | 1.12 | −19.45 |
| 3600 | −6.77 | 1.15 | −5.90 | −16.81 | 1.15 | −14.59 | −21.54 | 1.14 | −18.91 |
| 3700 | −6.76 | 1.15 | −5.86 | −16.74 | 1.16 | −14.45 | −21.53 | 1.15 | −18.80 |
| 3800 | −6.82 | 1.17 | −5.83 | −16.85 | 1.18 | −14.34 | −21.63 | 1.16 | −18.62 |
| 3900 | −6.76 | 1.21 | −5.60 | −16.86 | 1.21 | −13.92 | −21.75 | 1.20 | −18.16 |
| 4000 | −6.79 | 1.26 | −5.39 | −17.00 | 1.26 | −13.44 | −21.79 | 1.25 | −17.43 |
| 4100 | −6.84 | 1.26 | −5.42 | −17.19 | 1.27 | −13.56 | −21.78 | 1.25 | −17.38 |
| 4200 | −6.85 | 1.26 | −5.42 | −17.36 | 1.27 | −13.68 | −21.60 | 1.25 | −17.22 |
| 4300 | −6.89 | 1.31 | −5.26 | −17.46 | 1.31 | −13.28 | −21.44 | 1.30 | −16.49 |
| 4400 | −7.02 | 1.31 | −5.37 | −17.59 | 1.31 | −13.40 | −21.26 | 1.30 | −16.38 |
| 4500 | −7.16 | 1.28 | −5.59 | −17.73 | 1.28 | −13.80 | −20.87 | 1.27 | −16.43 |
| 4600 | −7.48 | 1.28 | −5.86 | −17.95 | 1.28 | −14.01 | −20.54 | 1.27 | −16.21 |
| 4700 | −77.7 | 1.19 | −6.53 | −18.02 | 1.19 | −15.08 | −20.16 | 1.18 | −17.06 |
| 4800 | −8.06 | 1.19 | −6.74 | −18.06 | 1.20 | −15.06 | −20.00 | 1.19 | −16.86 |

TABLE 3 provides estimates and standard errors of the Occlusion Effect for hearing devices evaluated by Group A. Increased positive values at frequencies between 200 Hz and 1000 Hz (the low frequency human hearing range sounds are mainly responsible in providing an occlusion effect) indicate greater occlusion effect. For example, a 10 dB value indicates the existence of a very significant occlusion effect. TABLE 4 provides comparisons of each non-Vivatone Group A device to the Vivatone device. Positive values indicate that the Occlusion Effect was greater for the non-Vivatone device. Negative values indicate that the Occlusion Effect was greater for the Vivatone device. T-values equal to or greater than 2.47 are statistically significant (adjusting for multiple comparisons). TABLES 3-4 follow:

TABLE 3

| | Occlusion Effect | | | | | | | |
|---|---|---|---|---|---|---|---|---|
| fre-quency | G: est | SE | O: est | SE | S: est | SE | V: est | SE |
| 200 | 2.09 | 1.59 | 7.52 | 1.60 | 17.58 | 1.56 | 0.01 | 1.57 |
| 300 | 1.59 | 1.35 | 8.23 | 1.36 | 19.08 | 1.33 | −0.08 | 1.34 |

TABLE 3-continued

| | Occlusion Effect | | | | | | | |
|---|---|---|---|---|---|---|---|---|
| fre-quency | G: est | SE | O: est | SE | S: est | SE | V: est | SE |
| 400 | 2.78 | 1.20 | 10.30 | 1.21 | 20.42 | 1.19 | 1.02 | 1.19 |
| 500 | 3.78 | 1.50 | 12.66 | 1.51 | 21.85 | 1.48 | 2.12 | 1.49 |
| 600 | 6.04 | 1.63 | 15.33 | 1.64 | 22.11 | 1.60 | 2.21 | 1.61 |
| 700 | 7.37 | 1.56 | 16.37 | 1.57 | 20.88 | 1.53 | 1.03 | 1.55 |
| 800 | 8.89 | 1.44 | 15.29 | 1.45 | 17.24 | 1.42 | −0.85 | 1.43 |
| 900 | 10.15 | 1.39 | 13.85 | 1.40 | 14.38 | 1.36 | −1.51 | 1.37 |
| 1000 | 8.54 | 1.53 | 10.29 | 1.54 | 11.98 | 1.51 | −1.30 | 1.52 |
| 1100 | 7.62 | 1.84 | 9.50 | 1.86 | 10.59 | 1.81 | −0.09 | 1.83 |
| 1200 | 6.55 | 1.69 | 7.59 | 1.71 | 8.04 | 1.67 | 0.41 | 1.68 |
| 1300 | 7.53 | 1.50 | 8.58 | 1.51 | 5.95 | 1.48 | 0.21 | 1.49 |
| 1400 | 6.79 | 1.35 | 7.87 | 1.36 | 4.47 | 1.33 | −0.07 | 1.34 |
| 1500 | 6.03 | 1.44 | 6.82 | 1.45 | 3.18 | 1.41 | −0.26 | 1.42 |
| 1600 | 6.62 | 1.64 | 5.84 | 1.65 | 1.61 | 1.61 | −0.38 | 1.63 |
| 1700 | 7.16 | 1.86 | 3.64 | 1.88 | −0.01 | 1.83 | −0.78 | 1.85 |
| 1800 | 7.06 | 1.98 | 1.76 | 1.99 | −2.32 | 1.95 | −0.64 | 1.96 |
| 1900 | 6.16 | 1.69 | 0.19 | 1.70 | −3.91 | 1.66 | −0.27 | 1.67 |
| 2000 | 5.68 | 1.38 | −2.00 | 1.39 | −5.12 | 1.36 | 0.81 | 1.37 |
| 2100 | 4.78 | 1.36 | −4.43 | 1.37 | −7.33 | 1.34 | 1.19 | 1.35 |
| 2200 | 3.08 | 1.33 | −6.21 | 1.34 | −9.61 | 1.31 | 1.07 | 1.32 |

TABLE 3-continued

| Occlusion Effect | | | | | | | | |
|---|---|---|---|---|---|---|---|---|
| fre-quency | G: est | SE | O: est | SE | S: est | SE | V: est | SE |
| 2300 | 0.62 | 1.16 | −9.31 | 1.17 | −12.37 | 1.14 | 0.36 | 1.15 |
| 2400 | −0.99 | 1.22 | −12.13 | 1.23 | −15.22 | 1.20 | −0.42 | 1.21 |
| 2500 | −3.49 | 1.27 | −14.06 | 1.28 | −17.19 | 1.25 | −1.79 | 1.26 |
| 2600 | −6.40 | 1.21 | −15.84 | 1.22 | −19.27 | 1.19 | −1.80 | 1.20 |
| 2700 | −7.36 | 1.25 | −16.94 | 1.26 | −20.26 | 1.23 | −2.03 | 1.24 |
| 2800 | −8.78 | 1.35 | −17.13 | 1.36 | −20.68 | 1.33 | −2.62 | 1.34 |
| 2900 | −10.14 | 1.24 | −18.13 | 1.25 | −21.72 | 1.22 | −2.98 | 1.23 |
| 3000 | −10.41 | 1.37 | −17.51 | 1.38 | −22.19 | 1.35 | −2.80 | 1.36 |
| 3100 | −10.78 | 1.47 | −17.52 | 1.48 | −22.54 | 1.44 | −3.33 | 1.45 |
| 3200 | −9.66 | 1.48 | −17.53 | 1.49 | −22.19 | 1.45 | −3.64 | 1.46 |
| 3300 | −9.60 | 1.47 | −17.93 | 1.48 | −21.83 | 1.45 | −3.78 | 1.46 |
| 3400 | −8.73 | 1.45 | −17.68 | 1.46 | −20.99 | 1.43 | −3.17 | 1.44 |
| 3500 | −8.45 | 1.52 | −16.91 | 1.54 | −19.46 | 1.50 | −3.07 | 1.51 |
| 3600 | −8.83 | 1.50 | −16.96 | 1.52 | −18.39 | 1.48 | −3.08 | 1.49 |

TABLE 3-continued

| Occlusion Effect | | | | | | | | |
|---|---|---|---|---|---|---|---|---|
| fre-quency | G: est | SE | O: est | SE | S: est | SE | V: est | SE |
| 3700 | −8.56 | 1.19 | −16.94 | 1.19 | −16.92 | 1.17 | −2.20 | 1.18 |
| 3800 | −8.62 | 1.21 | −16.04 | 1.22 | −15.71 | 1.19 | −2.19 | 1.20 |
| 3900 | −8.94 | 1.22 | −15.58 | 1.23 | −14.65 | 1.20 | −2.23 | 1.21 |
| 4000 | −8.56 | 1.12 | −14.66 | 1.12 | −13.67 | 1.10 | −1.30 | 1.11 |
| 4100 | −8.80 | 1.21 | −13.14 | 1.22 | −12.61 | 1.19 | −0.86 | 1.20 |
| 4200 | −8.59 | 1.37 | −11.01 | 1.38 | −11.27 | 1.35 | −0.34 | 1.36 |
| 4300 | −7.46 | 1.37 | −8.91 | 1.38 | −10.19 | 1.35 | −0.15 | 1.36 |
| 4400 | −6.62 | 1.33 | −7.25 | 1.34 | −8.98 | 1.31 | 0.05 | 1.32 |
| 4500 | −5.46 | 1.45 | −5.48 | 1.46 | −7.43 | 1.43 | 0.08 | 1.44 |
| 4600 | −4.99 | 1.49 | −3.71 | 1.51 | −6.43 | 1.47 | 0.34 | 1.48 |
| 4700 | −4.33 | 1.39 | −3.02 | 1.40 | −4.77 | 1.37 | 0.32 | 1.38 |
| 4800 | −3.54 | 1.22 | −2.95 | 1.22 | −3.64 | 1.20 | −0.04 | 1.21 |

TABLE 4

| Occlusion Effect Comparisons | | | | | | | | | |
|---|---|---|---|---|---|---|---|---|---|
| frequency | G vs V est | SE | t-value | O vs V est | SE | t-value | S vs V est | SE | t-value |
| 200 | 2.08 | 2.25 | 0.93 | 7.51 | 2.26 | 3.33 | 17.57 | 2.23 | 7.87 |
| 300 | 1.67 | 1.92 | 0.87 | 8.31 | 1.93 | 4.31 | 19.15 | 1.91 | 10.05 |
| 400 | 1.75 | 1.71 | 1.03 | 9.28 | 1.71 | 5.41 | 19.40 | 1.69 | 11.45 |
| 500 | 1.66 | 2.13 | 0.78 | 10.54 | 2.14 | 4.94 | 19.73 | 2.11 | 9.34 |
| 600 | 3.83 | 2.31 | 1.66 | 13.12 | 2.31 | 5.67 | 19.90 | 2.29 | 8.70 |
| 700 | 6.34 | 2.21 | 2.87 | 15.34 | 2.22 | 6.91 | 19.85 | 2.19 | 9.05 |
| 800 | 9.74 | 2.04 | 4.77 | 16.15 | 2.05 | 7.87 | 18.10 | 2.03 | 8.92 |
| 900 | 11.65 | 1.97 | 5.93 | 15.36 | 1.97 | 7.79 | 15.89 | 1.95 | 8.15 |
| 1000 | 9.84 | 2.17 | 4.54 | 11.60 | 2.18 | 5.32 | 13.29 | 2.15 | 6.17 |
| 1100 | 7.71 | 2.61 | 2.95 | 9.59 | 2.62 | 3.66 | 10.67 | 2.59 | 4.12 |
| 1200 | 6.14 | 2.40 | 2.56 | 7.18 | 2.41 | 2.98 | 7.63 | 2.39 | 3.20 |
| 1300 | 7.32 | 2.13 | 3.44 | 8.37 | 2.14 | 3.92 | 5.73 | 2.11 | 2.71 |
| 1400 | 6.86 | 1.91 | 3.59 | 7.94 | 1.92 | 4.14 | 4.54 | 1.90 | 2.39 |
| 1500 | 6.28 | 2.04 | 3.09 | 7.08 | 2.04 | 3.46 | 3.43 | 2.02 | 1.70 |
| 1600 | 7.00 | 2.33 | 3.01 | 6.22 | 2.33 | 2.67 | 1.99 | 2.31 | 0.86 |
| 1700 | 7.95 | 2.64 | 3.01 | 4.42 | 2.65 | 1.67 | 0.77 | 2.62 | 0.30 |
| 1800 | 7.71 | 2.81 | 2.74 | 2.41 | 2.82 | 0.85 | −1.67 | 2.79 | −0.60 |
| 1900 | 6.43 | 2.39 | 2.69 | 0.45 | 2.40 | 0.19 | −3.64 | 2.38 | −1.53 |
| 2000 | 4.88 | 1.95 | 2.50 | −2.81 | 1.96 | −1.43 | −5.93 | 1.94 | −3.06 |
| 2100 | 3.59 | 1.93 | 1.86 | −5.62 | 1.93 | −2.91 | −8.51 | 1.91 | −4.45 |
| 2200 | 2.01 | 1.89 | 1.06 | −7.28 | 1.89 | −3.85 | −10.68 | 1.87 | −5.71 |
| 2300 | 0.26 | 1.64 | 0.16 | −9.67 | 1.65 | −5.87 | −12.73 | 1.63 | −7.81 |
| 2400 | −0.57 | 1.73 | −0.33 | −11.70 | 1.74 | −6.73 | −14.79 | 1.72 | −8.60 |
| 2500 | −1.70 | 1.80 | −0.94 | −12.27 | 1.81 | −6.78 | −15.40 | 1.79 | −8.61 |
| 2600 | −4.60 | 1.71 | −2.69 | −14.04 | 1.72 | −8.18 | −17.46 | 1.70 | −10.29 |
| 2700 | −5.32 | 1.77 | −3.01 | −14.91 | 1.77 | −8.40 | −18.22 | 1.75 | −10.39 |
| 2800 | −6.17 | 1.91 | −3.23 | −14.52 | 1.92 | −7.57 | −18.07 | 1.90 | −9.53 |
| 2900 | −7.16 | 1.76 | −4.07 | −15.15 | 1.77 | −8.57 | −18.75 | 1.75 | −10.73 |
| 3000 | −7.60 | 1.95 | −3.91 | −14.71 | 1.95 | −7.53 | −19.38 | 1.93 | −10.03 |
| 3100 | −7.45 | 2.08 | −3.58 | −14.19 | 2.09 | −6.80 | −19.21 | 2.06 | −9.31 |
| 3200 | −6.03 | 2.09 | −2.88 | −13.89 | 2.10 | −6.61 | −18.56 | 2.08 | −8.93 |
| 3300 | −5.82 | 2.09 | −2.79 | −14.15 | 2.10 | −6.75 | −18.05 | 2.07 | −8.71 |
| 3400 | −5.56 | 2.06 | −2.70 | −14.51 | 2.07 | −7.01 | −17.82 | 2.05 | −8.71 |
| 3500 | −5.39 | 2.16 | −2.49 | −13.84 | 2.17 | −6.38 | −16.39 | 2.14 | −7.64 |
| 3600 | −5.76 | 2.13 | −2.70 | −13.89 | 2.14 | −6.48 | −15.31 | 2.12 | −7.23 |
| 3700 | −6.36 | 1.68 | −3.78 | −14.73 | 1.69 | −8.73 | −14.72 | 1.67 | −8.82 |
| 3800 | −6.42 | 1.71 | −3.75 | −13.85 | 1.72 | −8.05 | −13.51 | 1.70 | −7.95 |
| 3900 | −6.72 | 1.73 | −3.89 | −13.35 | 1.73 | −7.70 | −12.43 | 1.71 | −7.25 |
| 4000 | −7.27 | 1.58 | −4.60 | −13.36 | 1.59 | −8.42 | −12.38 | 1.57 | −7.89 |
| 4100 | −7.94 | 1.72 | −4.62 | −12.28 | 1.73 | −7.11 | −11.75 | 1.71 | −6.88 |
| 4200 | −8.24 | 1.94 | −4.24 | −10.66 | 1.95 | −5.46 | −10.92 | 1.93 | −5.66 |
| 4300 | −7.30 | 1.94 | −3.76 | −8.76 | 1.95 | −4.49 | −10.04 | 1.93 | −5.20 |
| 4400 | −6.67 | 1.89 | −3.53 | −7.31 | 1.90 | −3.85 | −9.03 | 1.88 | −4.82 |
| 4500 | −5.54 | 2.06 | −2.69 | −5.56 | 2.07 | −2.69 | −7.51 | 2.04 | −3.67 |
| 4600 | −5.33 | 2.12 | −2.51 | −4.05 | 2.13 | −1.90 | −6.77 | 2.10 | −3.22 |
| 4700 | −4.65 | 1.97 | −2.36 | −3.34 | 1.98 | −1.69 | −5.09 | 1.96 | −2.60 |
| 4800 | −3.49 | 1.72 | −2.02 | −2.90 | 1.73 | −1.68 | −3.60 | 1.71 | −2.10 |

TABLE 5 provides estimates and standard errors of the Insertion Response for hearing devices evaluated by Group B. TABLE 6 provides comparisons of each Vivatone Group B device condition to the None condition (that is, no receiver unit in the ear). Positive values indicate that the Insertion Response was greater for the Vivatone device condition. Negative values indicate that the Insertion Response was greater for the None condition. T-values equal to or greater than 2.59 are statistically significant (adjusting for multiple comparisons). TABLES 5-6 follow:

TABLE 5

| | Insertion Gain | | | | | | | | | | | |
|---|---|---|---|---|---|---|---|---|---|---|---|---|
| frequency | None: est | SE | V: est | SE | 1: est | SE | 2: est | SE | 3: est | SE | 4: est | SE |
| 200 | 0.10 | 0.18 | 0.24 | 0.18 | 0.05 | 0.18 | −0.03 | 0.19 | 0.30 | 0.18 | 0.25 | 0.19 |
| 300 | 0.04 | 0.18 | 0.23 | 0.18 | 0.16 | 0.18 | 0.02 | 0.19 | 0.42 | 0.18 | 0.41 | 0.19 |
| 400 | −0.04 | 0.09 | 0.21 | 0.09 | 0.22 | 0.09 | 0.22 | 0.09 | 0.48 | 0.09 | 0.39 | 0.09 |
| 500 | −0.02 | 0.06 | 0.21 | 0.06 | 0.24 | 0.06 | 0.34 | 0.06 | 0.59 | 0.06 | 0.57 | 0.07 |
| 600 | −0.01 | 0.08 | 0.23 | 0.08 | 0.33 | 0.08 | 0.47 | 0.08 | 0.67 | 0.08 | 0.73 | 0.08 |
| 700 | −0.05 | 0.10 | 0.35 | 0.10 | 0.41 | 0.10 | 0.64 | 0.10 | 0.77 | 0.10 | 1.01 | 0.10 |
| 800 | −0.10 | 0.09 | 0.49 | 0.09 | 0.46 | 0.09 | 0.77 | 0.10 | 0.91 | 0.09 | 1.24 | 0.10 |
| 900 | −0.09 | 0.14 | 0.28 | 0.14 | 0.56 | 0.14 | 0.86 | 0.14 | 1.08 | 0.14 | 1.45 | 0.14 |
| 1000 | −0.09 | 0.20 | 0.13 | 0.20 | 0.65 | 0.20 | 0.89 | 0.20 | 1.18 | 0.20 | 1.62 | 0.20 |
| 1100 | −0.11 | 0.17 | 0.33 | 0.17 | 0.68 | 0.17 | 0.82 | 0.17 | 1.33 | 0.17 | 1.57 | 0.17 |
| 1200 | 0.00 | 0.17 | 0.39 | 0.17 | 0.72 | 0.17 | 0.76 | 0.18 | 1.41 | 0.17 | 1.37 | 0.18 |
| 1300 | 0.07 | 0.20 | 0.47 | 0.20 | 0.66 | 0.20 | 0.72 | 0.20 | 1.32 | 0.20 | 1.23 | 0.20 |
| 1400 | 0.02 | 0.20 | 0.65 | 0.20 | 0.58 | 0.20 | 0.81 | 0.21 | 1.27 | 0.20 | 1.06 | 0.21 |
| 1500 | 0.08 | 0.21 | 0.77 | 0.21 | 0.60 | 0.21 | 0.99 | 0.22 | 1.34 | 0.21 | 0.94 | 0.22 |
| 1600 | 0.09 | 0.25 | 0.74 | 0.25 | 0.62 | 0.25 | 1.08 | 0.25 | 1.41 | 0.25 | 0.77 | 0.25 |
| 1700 | 0.03 | 0.30 | 0.74 | 0.30 | 0.72 | 0.30 | 1.10 | 0.31 | 1.26 | 0.30 | 0.14 | 0.31 |
| 1800 | −0.07 | 0.33 | 0.80 | 0.34 | 0.78 | 0.34 | 0.88 | 0.34 | 0.84 | 0.34 | −0.55 | 0.34 |
| 1900 | −0.01 | 0.38 | 0.70 | 0.38 | 0.64 | 0.38 | 0.50 | 0.39 | 0.12 | 0.38 | −1.39 | 0.39 |
| 2000 | 0.02 | 0.41 | 0.25 | 0.42 | 0.34 | 0.42 | −0.27 | 0.42 | −0.98 | 0.42 | −2.61 | 0.43 |
| 2100 | −0.06 | 0.47 | −0.17 | 0.48 | −0.05 | 0.48 | −1.10 | 0.49 | −2.05 | 0.48 | −3.79 | 0.49 |
| 2200 | −0.08 | 0.52 | −0.64 | 0.53 | −0.61 | 0.53 | −2.06 | 0.54 | −3.27 | 0.53 | −4.82 | 0.54 |
| 2300 | −0.10 | 0.54 | −1.06 | 0.54 | −1.16 | 0.54 | −2.88 | 0.55 | −4.12 | 0.54 | −5.69 | 0.55 |
| 2400 | −0.04 | 0.52 | −1.48 | 0.53 | −1.65 | 0.53 | −3.54 | 0.53 | −4.78 | 0.53 | −6.27 | 0.54 |
| 2500 | −0.05 | 0.51 | −1.81 | 0.51 | −1.89 | 0.51 | −3.88 | 0.52 | −5.24 | 0.51 | −6.75 | 0.53 |
| 2600 | −0.05 | 0.50 | −1.98 | 0.51 | −2.08 | 0.51 | −4.11 | 0.52 | −5.61 | 0.51 | −7.01 | 0.52 |
| 2700 | 0.04 | 0.49 | −1.98 | 0.49 | −2.18 | 0.49 | −4.17 | 0.50 | −5.70 | 0.49 | −7.28 | 0.51 |
| 2800 | 0.13 | 0.47 | −1.99 | 0.48 | −2.22 | 0.48 | −4.23 | 0.48 | −5.72 | 0.48 | −7.30 | 0.49 |
| 2900 | 0.17 | 0.46 | −1.96 | 0.46 | −2.19 | 0.46 | −4.14 | 0.47 | −5.66 | 0.46 | −7.22 | 0.47 |
| 3000 | 0.09 | 0.43 | −1.87 | 0.44 | −2.12 | 0.44 | −4.10 | 0.44 | −5.51 | 0.44 | −6.96 | 0.45 |
| 3100 | 0.12 | 0.42 | −1.74 | 0.42 | −2.07 | 0.42 | −3.93 | 0.43 | −5.35 | 0.42 | −6.73 | 0.44 |
| 3200 | 0.15 | 0.39 | −1.60 | 0.39 | −2.00 | 0.39 | −3.84 | 0.40 | −5.06 | 0.40 | −6.53 | 0.40 |
| 3300 | 0.15 | 0.38 | −1.58 | 0.38 | −1.92 | 0.38 | −3.71 | 0.39 | −4.84 | 0.38 | −6.26 | 0.39 |
| 3400 | 0.15 | 0.37 | −1.45 | 0.38 | −1.89 | 0.38 | −3.50 | 0.38 | −4.65 | 0.38 | −6.08 | 0.39 |
| 3500 | 0.20 | 0.37 | −1.47 | 0.37 | −1.87 | 0.37 | −3.43 | 0.38 | −4.40 | 0.37 | −5.95 | 0.38 |
| 3600 | 0.22 | 0.38 | −1.49 | 0.39 | −1.82 | 0.39 | −3.43 | 0.39 | −4.37 | 0.39 | −5.83 | 0.40 |
| 3700 | 0.24 | 0.40 | −1.48 | 0.40 | −1.91 | 0.40 | −3.35 | 0.41 | −4.39 | 0.40 | −5.90 | 0.41 |
| 3800 | 0.32 | 0.42 | −1.55 | 0.42 | −1.86 | 0.42 | −3.40 | 0.43 | −4.46 | 0.42 | −5.87 | 0.43 |
| 3900 | 0.29 | 0.44 | −1.51 | 0.44 | −1.88 | 0.44 | −3.45 | 0.45 | −4.48 | 0.44 | −5.92 | 0.45 |
| 4000 | 0.23 | 0.43 | −1.48 | 0.44 | −2.01 | 0.44 | −3.52 | 0.44 | −4.58 | 0.44 | −6.15 | 0.45 |
| 4100 | 0.20 | 0.43 | −1.53 | 0.43 | −1.96 | 0.43 | −3.56 | 0.44 | −4.62 | 0.43 | −6.08 | 0.44 |
| 4200 | 0.21 | 0.44 | −1.59 | 0.44 | −1.99 | 0.44 | −3.54 | 0.45 | −4.64 | 0.44 | −6.19 | 0.45 |
| 4300 | 0.16 | 0.43 | −1.57 | 0.43 | −1.86 | 0.43 | −3.51 | 0.44 | −4.64 | 0.43 | −6.15 | 0.45 |
| 4400 | 0.14 | 0.44 | −1.55 | 0.44 | −1.69 | 0.44 | −3.45 | 0.45 | −4.53 | 0.44 | −6.05 | 0.45 |
| 4500 | 0.16 | 0.42 | −1.60 | 0.43 | −1.66 | 0.43 | −3.44 | 0.43 | −4.47 | 0.43 | −5.95 | 0.44 |
| 4600 | 0.15 | 0.42 | −1.62 | 0.42 | −1.57 | 0.42 | −3.37 | 0.43 | −4.44 | 0.42 | −5.87 | 0.43 |
| 4700 | 0.13 | 0.40 | −1.65 | 0.40 | −1.55 | 0.40 | −3.32 | 0.41 | −4.35 | 0.40 | −5.60 | 0.41 |
| 4800 | 0.07 | 0.40 | −1.66 | 0.40 | −1.55 | 0.40 | −3.27 | 0.41 | −4.32 | 0.40 | −5.52 | 0.41 |

TABLE 6

| | Insertion Gain Comparisons | | | | | | | | | | |
|---|---|---|---|---|---|---|---|---|---|---|---|
| frequency | V vs None est | SE | t-value | 1 vs None est | SE | t-values | 2 vs None est | SE | t-value | 3 vs None est | SE |
| 200 | 0.14 | 0.26 | 0.55 | −0.05 | 0.26 | −0.18 | −0.13 | 0.26 | −0.49 | 0.21 | 0.26 |
| 300 | 0.20 | 0.26 | 0.76 | 0.12 | 0.26 | 0.46 | −0.01 | 0.26 | −0.05 | 0.39 | 0.26 |
| 400 | 0.24 | 0.13 | 1.86 | 0.25 | 0.13 | 1.95 | 0.25 | 0.13 | 1.96 | 0.52 | 0.13 |
| 500 | 0.23 | 0.09 | 2.54 | 0.26 | 0.09 | 2.84 | 0.37 | 0.09 | 4.09 | 0.61 | 0.09 |
| 600 | 0.24 | 0.11 | 2.18 | 0.34 | 0.11 | 3.07 | 0.48 | 0.11 | 4.37 | 0.68 | 0.11 |
| 700 | 0.40 | 0.13 | 2.96 | 0.45 | 0.14 | 3.33 | 0.68 | 0.13 | 5.08 | 0.81 | 0.14 |
| 800 | 0.58 | 0.13 | 4.34 | 0.55 | 0.13 | 4.12 | 0.86 | 0.13 | 6.51 | 1.01 | 0.14 |
| 900 | 0.36 | 0.20 | 1.84 | 0.64 | 0.20 | 3.23 | 0.95 | 0.20 | 4.82 | 1.17 | 0.20 |
| 1000 | 0.22 | 0.28 | 0.77 | 0.73 | 0.28 | 2.60 | 0.98 | 0.28 | 3.51 | 1.26 | 0.28 |
| 1100 | 0.44 | 0.24 | 1.87 | 0.79 | 0.24 | 3.33 | 0.93 | 0.23 | 3.99 | 1.44 | 0.24 |
| 1200 | 0.39 | 0.25 | 1.57 | 0.72 | 0.25 | 2.89 | 0.76 | 0.24 | 3.09 | 1.41 | 0.25 |

TABLE 6-continued

| Insertion Gain Comparisons | | | | | | | | | | | |
|---|---|---|---|---|---|---|---|---|---|---|---|
| frequency | V vs None est | SE | t-value | 1 vs None est | SE | t-values | 2 vs None est | SE | t-value | 3 vs None est | SE |
| 1300 | 0.41 | 0.28 | 1.46 | 0.59 | 0.28 | 2.12 | 0.66 | 0.28 | 2.39 | 1.25 | 0.28 |
| 1400 | 0.63 | 0.29 | 2.19 | 0.56 | 0.29 | 1.94 | 0.79 | 0.28 | 2.78 | 1.25 | 0.29 |
| 1500 | 0.69 | 0.30 | 2.27 | 0.51 | 0.30 | 1.69 | 0.91 | 0.30 | 3.04 | 1.25 | 0.31 |
| 1600 | 0.65 | 0.35 | 1.85 | 0.53 | 0.35 | 1.49 | 0.99 | 0.35 | 2.83 | 1.32 | 0.35 |
| 1700 | 0.72 | 0.42 | 1.69 | 0.69 | 0.43 | 1.63 | 1.07 | 0.42 | 2.54 | 1.23 | 0.43 |
| 1800 | 0.87 | 0.47 | 1.84 | 0.86 | 0.48 | 1.80 | 0.95 | 0.47 | 2.02 | 0.91 | 0.48 |
| 1900 | 0.71 | 0.53 | 1.33 | 0.65 | 0.54 | 1.21 | 0.51 | 0.53 | 0.95 | 0.13 | 0.54 |
| 2000 | 0.23 | 0.59 | 0.39 | 0.32 | 0.59 | 0.54 | −0.29 | 0.58 | −0.50 | −1.00 | 0.59 |
| 2100 | −0.11 | 0.67 | −0.16 | 0.01 | 0.68 | 0.01 | −1.04 | 0.67 | −1.56 | −2.00 | 0.68 |
| 2200 | −0.56 | 0.74 | −0.75 | −0.53 | 0.75 | −0.70 | −1.98 | 0.74 | −2.68 | −3.19 | 0.75 |
| 2300 | −0.95 | 0.76 | −1.26 | −1.06 | 0.76 | −1.38 | −2.77 | 0.75 | −3.68 | −4.02 | 0.77 |
| 2400 | −1.45 | 0.74 | −1.95 | −1.61 | 0.75 | −2.16 | −3.51 | 0.74 | −4.77 | −4.74 | 0.75 |
| 2500 | −1.76 | 0.72 | −2.44 | −1.84 | 0.73 | −2.52 | −3.83 | 0.72 | −5.33 | −5.19 | 0.73 |
| 2600 | −1.92 | 0.71 | −2.69 | −2.03 | 0.72 | −2.82 | −4.06 | 0.71 | −5.71 | −5.55 | 0.72 |
| 2700 | −2.02 | 0.69 | −2.90 | −2.21 | 0.70 | −3.16 | −4.21 | 0.69 | −6.10 | −5.73 | 0.70 |
| 2800 | −2.11 | 0.67 | −3.15 | −2.35 | 0.68 | −3.47 | −4.36 | 0.67 | −6.54 | −5.84 | 0.68 |
| 2900 | −2.13 | 0.65 | −3.28 | −2.36 | 0.65 | −3.61 | −4.30 | 0.64 | −6.69 | −5.83 | 0.66 |
| 3000 | −1.96 | 0.61 | −3.19 | −2.21 | 0.62 | −3.57 | −4.19 | 0.61 | −6.87 | −5.60 | 0.62 |
| 3100 | −1.86 | 0.60 | −3.11 | −2.19 | 0.60 | −3.64 | −4.05 | 0.59 | −6.81 | −5.47 | 0.61 |
| 3200 | −1.74 | 0.56 | −3.13 | −2.15 | 0.56 | −3.83 | −3.99 | 0.55 | −7.21 | −5.21 | 0.56 |
| 3300 | −1.73 | 0.54 | −3.20 | −2.07 | 0.55 | −3.80 | −3.85 | 0.54 | −7.16 | −4.98 | 0.55 |
| 3400 | −1.61 | 0.53 | −3.04 | −2.04 | 0.53 | −3.83 | −3.65 | 0.53 | −6.94 | −4.80 | 0.54 |
| 3500 | −1.66 | 0.53 | −3.16 | −2.07 | 0.53 | −3.90 | −3.62 | 0.52 | −6.93 | −4.60 | 0.53 |
| 3600 | −1.71 | 0.54 | −3.14 | −2.04 | 0.55 | −3.73 | −3.64 | 0.54 | −6.74 | −4.59 | 0.55 |
| 3700 | −1.72 | 0.57 | −3.03 | −2.15 | 0.57 | −3.76 | −3.59 | 0.56 | −6.36 | −4.63 | 0.58 |
| 3800 | −1.88 | 0.60 | −3.15 | −2.19 | 0.60 | −3.64 | −3.72 | 0.59 | −6.29 | −4.78 | 0.60 |
| 3900 | −1.81 | 0.62 | −2.91 | −2.18 | 0.63 | −3.48 | −3.74 | 0.62 | −6.06 | −4.77 | 0.63 |
| 4000 | −1.71 | 0.62 | −2.78 | −2.24 | 0.62 | −3.61 | −3.75 | 0.61 | −6.14 | −4.82 | 0.62 |
| 4100 | −1.72 | 0.61 | −2.82 | −2.16 | 0.61 | −3.51 | −3.76 | 0.61 | −6.20 | −4.81 | 0.62 |
| 4200 | −1.81 | 0.62 | −2.89 | −2.21 | 0.63 | −3.50 | −3.75 | 0.62 | −6.04 | −4.85 | 0.63 |
| 4300 | −1.74 | 0.61 | −2.84 | −2.02 | 0.62 | −3.28 | −3.68 | 0.61 | −6.05 | −4.81 | 0.62 |
| 4400 | −1.69 | 0.62 | −2.72 | −1.83 | 0.63 | −2.92 | −3.59 | 0.62 | −5.82 | −4.67 | 0.63 |
| 4500 | −1.76 | 0.60 | −2.93 | −1.82 | 0.60 | −3.02 | −3.60 | 0.60 | −6.04 | −4.63 | 0.61 |
| 4600 | −1.77 | 0.59 | −2.98 | −1.72 | 0.60 | −2.88 | −3.52 | 0.59 | −5.97 | −4.59 | 0.60 |
| 4700 | −1.78 | 0.57 | −3.13 | −1.68 | 0.57 | −2.94 | −3.45 | 0.56 | −6.13 | −4.48 | 0.57 |
| 4800 | −1.73 | 0.57 | −3.06 | −1.62 | 0.57 | −2.85 | −3.34 | 0.56 | −5.95 | −4.39 | 0.57 |

TABLE 7 provides estimates and standard errors of the Occlusion Effect for hearing devices evaluated by Group B. TABLE 8 provides comparisons of each Vivatone Group B device condition to the None condition. Positive values indicate that the Occlusion Effect was greater for the Vivatone device condition. Negative values indicate that the Occlusion Effect was greater for the None condition. T-values equal to or greater than 2.59 are statistically significant (adjusting for multiple comparisons). TABLES 7-8 follow:

TABLE 7

| Occlusion Effect | | | | | | | | | | | | |
|---|---|---|---|---|---|---|---|---|---|---|---|---|
| frequency | None: est | SE | V: est | SE | 1: est | SE | 2: est | SE | 3: est | SE | 4: est | SE |
| 200 | 2.37 | 1.09 | 1.80 | 1.10 | 1.75 | 1.10 | 0.95 | 1.12 | 2.70 | 1.10 | 3.70 | 1.13 |
| 300 | 2.20 | 0.99 | 1.92 | 1.00 | 2.43 | 1.00 | 1.37 | 1.02 | 2.35 | 1.00 | 3.73 | 1.02 |
| 400 | 2.95 | 1.00 | 2.26 | 1.01 | 3.36 | 1.01 | 1.70 | 1.03 | 2.51 | 1.01 | 3.26 | 1.03 |
| 500 | 1.81 | 0.91 | 2.82 | 0.91 | 3.32 | 0.91 | 2.31 | 0.93 | 2.51 | 0.91 | 3.63 | 0.94 |
| 600 | 1.67 | 1.11 | 3.37 | 1.11 | 2.76 | 1.11 | 3.10 | 1.13 | 3.04 | 1.11 | 4.51 | 1.14 |
| 700 | 0.47 | 1.33 | 3.33 | 1.33 | 1.75 | 1.33 | 3.40 | 1.36 | 3.82 | 1.34 | 5.38 | 1.37 |
| 800 | 0.68 | 1.39 | 2.46 | 1.40 | 0.97 | 1.40 | 1.92 | 1.43 | 3.55 | 1.40 | 4.42 | 1.44 |
| 900 | 0.54 | 1.28 | 1.24 | 1.29 | 0.97 | 1.29 | 2.84 | 1.31 | 3.35 | 1.29 | 4.44 | 1.32 |
| 1000 | 1.37 | 1.13 | 1.19 | 1.13 | 1.35 | 1.13 | 2.48 | 1.15 | 4.72 | 1.14 | 3.80 | 1.16 |
| 1100 | 1.66 | 0.98 | 1.55 | 0.99 | 1.83 | 0.99 | 3.01 | 1.00 | 4.90 | 0.99 | 4.18 | 1.01 |
| 1200 | 0.80 | 1.07 | 1.82 | 1.08 | 1.45 | 1.08 | 2.07 | 1.10 | 5.15 | 1.08 | 4.49 | 1.11 |
| 1300 | 0.15 | 1.30 | 0.44 | 1.31 | 0.97 | 1.31 | 2.21 | 1.33 | 4.43 | 1.31 | 5.16 | 1.34 |
| 1400 | −0.70 | 1.37 | −0.22 | 1.38 | 0.63 | 1.38 | 2.18 | 1.40 | 4.70 | 1.38 | 5.13 | 1.41 |
| 1500 | −0.97 | 1.39 | −0.91 | 1.40 | 0.54 | 1.40 | 2.38 | 1.43 | 3.85 | 1.40 | 4.29 | 1.44 |
| 1600 | −0.81 | 1.32 | −0.22 | 1.33 | 0.82 | 1.33 | 2.06 | 1.35 | 4.34 | 1.33 | 4.17 | 1.36 |
| 1700 | 0.37 | 1.19 | 0.01 | 1.20 | 1.75 | 1.20 | 3.02 | 1.22 | 4.19 | 1.20 | 3.67 | 1.23 |
| 1800 | 1.01 | 1.18 | −0.27 | 1.18 | 2.15 | 1.18 | 3.22 | 1.20 | 3.77 | 1.18 | 3.46 | 1.21 |
| 1900 | 0.83 | 1.24 | −0.23 | 1.25 | 1.39 | 1.25 | 3.36 | 1.27 | 2.14 | 1.25 | 2.41 | 1.28 |
| 2000 | 1.36 | 1.24 | 0.30 | 1.25 | 0.06 | 1.25 | 2.36 | 1.27 | 0.90 | 1.25 | 2.03 | 1.28 |
| 2100 | 1.51 | 1.24 | −0.20 | 1.25 | −0.39 | 1.25 | 1.06 | 1.27 | 0.24 | 1.25 | 0.32 | 1.28 |
| 2200 | 1.97 | 1.20 | −0.33 | 1.20 | −0.44 | 1.20 | −0.21 | 1.22 | −1.01 | 1.20 | −1.77 | 1.23 |

TABLE 7-continued

| | Occlusion Effect | | | | | | | | | | | |
|---|---|---|---|---|---|---|---|---|---|---|---|---|
| frequency | None: est | SE | V: est | SE | 1: est | SE | 2: est | SE | 3: est | SE | 4: est | SE |
| 2300 | 2.49 | 1.12 | −0.37 | 1.13 | −0.98 | 1.13 | −2.05 | 1.15 | −2.42 | 1.13 | −2.67 | 1.15 |
| 2400 | 2.10 | 1.11 | −0.44 | 1.12 | −1.46 | 1.12 | −2.90 | 1.14 | −4.10 | 1.12 | −3.86 | 1.15 |
| 2500 | 1.18 | 1.16 | −1.07 | 1.17 | −1.94 | 1.17 | −4.20 | 1.19 | −5.19 | 1.17 | −4.58 | 1.20 |
| 2600 | 0.59 | 1.22 | −1.63 | 1.23 | −1.86 | 1.23 | −4.41 | 1.25 | −6.13 | 1.23 | −6.04 | 1.26 |
| 2700 | −0.03 | 1.22 | −1.90 | 1.23 | −2.57 | 1.23 | −4.80 | 1.25 | −6.40 | 1.23 | −6.67 | 1.26 |
| 2800 | 0.24 | 1.12 | −1.69 | 1.13 | −3.10 | 1.13 | −4.63 | 1.15 | −5.68 | 1.13 | −6.89 | 1.16 |
| 2900 | 0.27 | 1.13 | −1.90 | 1.14 | −3.57 | 1.14 | −5.04 | 1.16 | −5.49 | 1.14 | −6.82 | 1.16 |
| 3000 | 0.56 | 1.18 | −2.62 | 1.18 | −3.61 | 1.18 | −4.91 | 1.20 | −5.30 | 1.18 | −6.86 | 1.21 |
| 3100 | 0.64 | 1.15 | −2.61 | 1.15 | −3.58 | 1.15 | −4.43 | 1.17 | −5.12 | 1.15 | −6.77 | 1.18 |
| 3200 | 0.42 | 1.18 | −2.49 | 1.19 | −3.36 | 1.19 | −4.16 | 1.21 | −4.93 | 1.19 | −6.93 | 1.22 |
| 3300 | 0.42 | 1.23 | −2.99 | 1.23 | −2.88 | 1.23 | −3.77 | 1.26 | −4.82 | 1.23 | −7.07 | 1.27 |
| 3400 | 0.41 | 1.26 | −3.47 | 1.27 | −2.57 | 1.27 | −2.92 | 1.29 | −4.57 | 1.27 | −6.88 | 1.30 |
| 3500 | 0.74 | 1.28 | −3.42 | 1.29 | −2.26 | 1.29 | −3.02 | 1.31 | −4.00 | 1.29 | −6.60 | 1.32 |
| 3600 | 0.80 | 1.22 | −3.09 | 1.23 | −1.49 | 1.23 | −2.47 | 1.25 | −3.26 | 1.23 | −6.85 | 1.26 |
| 3700 | 0.87 | 1.19 | −3.00 | 1.20 | −0.99 | 1.20 | −1.84 | 1.22 | −2.98 | 1.20 | −6.90 | 1.23 |
| 3800 | 0.29 | 1.16 | −3.13 | 1.17 | −0.94 | 1.17 | −1.82 | 1.19 | −3.13 | 1.17 | −6.65 | 1.20 |
| 3900 | −0.44 | 1.15 | −2.98 | 1.16 | −0.98 | 1.16 | −1.70 | 1.18 | −2.93 | 1.16 | −5.86 | 1.19 |
| 4000 | −0.24 | 0.95 | −1.64 | 0.95 | −1.07 | 0.95 | −0.94 | 0.97 | −2.67 | 0.95 | −5.09 | 0.98 |
| 4100 | −0.36 | 0.95 | −1.26 | 0.96 | −1.12 | 0.96 | −1.29 | 0.98 | −2.81 | 0.96 | −4.89 | 0.99 |
| 4200 | −0.28 | 0.98 | −0.59 | 0.98 | −0.93 | 0.98 | −1.25 | 1.00 | −2.30 | 0.98 | −4.86 | 1.01 |
| 4300 | −0.15 | 1.03 | −0.01 | 1.04 | −0.99 | 1.04 | −1.33 | 1.06 | −2.51 | 1.04 | −4.37 | 1.07 |
| 4400 | 0.01 | 1.04 | 0.35 | 1.05 | −1.14 | 1.05 | −1.69 | 1.07 | −2.29 | 1.05 | −3.96 | 1.07 |
| 4500 | 0.33 | 1.08 | 0.34 | 1.09 | −1.01 | 1.09 | −1.31 | 1.11 | −0.80 | 1.09 | −3.66 | 1.12 |
| 4600 | 0.87 | 1.04 | 0.45 | 1.05 | −0.78 | 1.05 | −1.27 | 1.07 | −1.07 | 1.05 | −3.16 | 1.08 |
| 4700 | 0.89 | 0.92 | 0.45 | 0.93 | −0.57 | 0.93 | −1.42 | 0.94 | −0.99 | 0.93 | −2.72 | 0.95 |
| 4800 | 0.87 | 0.91 | 0.89 | 0.91 | −0.62 | 0.91 | −1.31 | 0.93 | −0.87 | 0.91 | −2.29 | 0.93 |

TABLE 8

| | Occlusion Effect Comparisons | | | | | | | | | | |
|---|---|---|---|---|---|---|---|---|---|---|---|
| frequency | V vs None est | SE | t-value | 1 vs None est | SE | t-values | 2 vs None est | SE | t-value | 3 vs None est | SE |
| 200 | −0.56 | 1.55 | −0.36 | −0.62 | 1.56 | −0.40 | −1.42 | 1.54 | −0.92 | 0.33 | 1.57 |
| 300 | −0.28 | 1.41 | −0.20 | 0.23 | 1.42 | 0.16 | −0.82 | 1.40 | −0.59 | 0.15 | 1.43 |
| 400 | −0.69 | 1.42 | −0.48 | 0.41 | 1.43 | 0.28 | −1.25 | 1.41 | −0.88 | −0.44 | 1.44 |
| 500 | 1.02 | 1.29 | 0.79 | 1.51 | 1.29 | 1.17 | 0.50 | 1.28 | 0.39 | 0.71 | 1.30 |
| 600 | 1.70 | 1.57 | 1.08 | 1.08 | 1.58 | 0.69 | 1.43 | 1.56 | 0.92 | 1.36 | 1.59 |
| 700 | 2.86 | 1.88 | 1.52 | 1.28 | 1.89 | 0.68 | 2.93 | 1.87 | 1.57 | 3.35 | 1.90 |
| 800 | 1.78 | 1.98 | 0.90 | 0.29 | 1.99 | 0.15 | 1.24 | 1.96 | 0.63 | 2.87 | 2.00 |
| 900 | 0.70 | 1.81 | 0.39 | 0.42 | 1.82 | 0.23 | 2.29 | 1.80 | 1.28 | 2.81 | 1.83 |
| 1000 | −0.18 | 1.60 | −0.11 | −0.02 | 1.61 | −0.01 | 1.11 | 1.59 | 0.70 | 3.35 | 1.62 |
| 1100 | −0.11 | 1.39 | −0.08 | 0.18 | 1.40 | 0.13 | 1.36 | 1.38 | 0.98 | 3.24 | 1.41 |
| 1200 | 1.01 | 1.52 | 0.67 | 0.65 | 1.53 | 0.42 | 1.27 | 1.51 | 0.84 | 4.35 | 1.54 |
| 1300 | 0.30 | 1.84 | 0.16 | 0.82 | 1.85 | 0.44 | 2.07 | 1.83 | 1.13 | 4.28 | 1.86 |
| 1400 | 0.48 | 1.94 | 0.25 | 1.33 | 1.95 | 0.68 | 2.87 | 1.93 | 1.49 | 5.39 | 1.96 |
| 1500 | 0.06 | 1.98 | 0.03 | 1.51 | 1.99 | 0.76 | 3.35 | 1.96 | 1.71 | 4.83 | 2.00 |
| 1600 | 0.59 | 1.87 | 0.31 | 1.63 | 1.88 | 0.86 | 2.87 | 1.86 | 1.54 | 5.15 | 1.89 |
| 1700 | −0.36 | 1.68 | −0.22 | 1.38 | 1.70 | 0.81 | 2.65 | 1.67 | 1.58 | 3.82 | 1.70 |
| 1800 | −1.28 | 1.67 | −0.77 | 1.14 | 1.68 | 0.68 | 2.21 | 1.66 | 1.34 | 2.76 | 1.69 |
| 1900 | −1.06 | 1.76 | −0.60 | 0.56 | 1.77 | 0.32 | 2.53 | 1.75 | 1.45 | 1.31 | 1.78 |
| 2000 | −1.06 | 1.76 | −0.60 | −1.30 | 1.77 | −0.73 | 0.99 | 1.75 | 0.57 | −0.46 | 1.78 |
| 2100 | −1.71 | 1.76 | −0.97 | −1.90 | 1.77 | −1.07 | −0.45 | 1.75 | −0.26 | −1.27 | 1.78 |
| 2200 | −2.30 | 1.70 | −1.36 | −2.41 | 1.71 | −1.41 | −2.18 | 1.68 | −1.30 | −2.98 | 1.72 |
| 2300 | −2.86 | 1.59 | −1.80 | −3.47 | 1.60 | −2.17 | −4.54 | 1.58 | −2.88 | −4.90 | 1.61 |
| 2400 | −2.53 | 1.58 | −1.61 | −3.56 | 1.59 | −2.24 | −5.00 | 1.57 | −3.19 | −6.19 | 1.60 |
| 2500 | −2.25 | 1.65 | −1.36 | −3.12 | 1.66 | −1.88 | −5.38 | 1.64 | −3.28 | −6.37 | 1.67 |
| 2600 | −2.23 | 1.73 | −1.29 | −2.46 | 1.74 | −1.41 | −5.01 | 1.72 | −2.92 | −6.72 | 1.75 |
| 2700 | −1.87 | 1.74 | −1.08 | −2.54 | 1.75 | −1.45 | −4.77 | 1.73 | −2.76 | −6.37 | 1.76 |
| 2800 | −1.93 | 1.59 | −1.21 | −3.34 | 1.60 | −2.08 | −4.86 | 1.58 | −3.08 | −5.92 | 1.61 |
| 2900 | −2.17 | 1.60 | −1.35 | −3.83 | 1.61 | −2.38 | −5.31 | 1.59 | −3.34 | −5.75 | 1.62 |
| 3000 | −3.18 | 1.67 | −1.91 | −4.17 | 1.68 | −2.48 | −5.47 | 1.66 | −3.30 | −5.86 | 1.69 |
| 3100 | −3.24 | 1.63 | −2.00 | −4.22 | 1.64 | −2.58 | −5.07 | 1.61 | −3.14 | −5.75 | 1.64 |
| 3200 | −2.91 | 1.68 | −1.74 | −3.78 | 1.69 | −2.24 | −4.58 | 1.67 | −2.75 | −5.35 | 1.70 |
| 3300 | −3.42 | 1.74 | −1.97 | −3.31 | 1.75 | −1.89 | −4.19 | 1.73 | −2.43 | −5.24 | 1.76 |
| 3400 | −3.88 | 1.79 | −2.17 | −2.98 | 1.80 | −1.65 | −3.34 | 1.78 | −1.88 | −4.99 | 1.81 |
| 3500 | −4.17 | 1.82 | −2.29 | −3.00 | 1.83 | −1.64 | −3.76 | 1.80 | −2.08 | −4.74 | 1.84 |
| 3600 | −3.89 | 1.73 | −2.25 | −2.29 | 1.74 | −1.31 | −3.27 | 1.72 | −1.90 | −4.06 | 1.75 |
| 3700 | −3.87 | 1.69 | −2.29 | −1.87 | 1.70 | −1.10 | −2.71 | 1.68 | −1.61 | −3.85 | 1.71 |
| 3800 | −3.42 | 1.65 | −2.07 | −1.24 | 1.66 | −0.75 | −2.11 | 1.64 | −1.29 | −3.42 | 1.67 |
| 3900 | −2.54 | 1.63 | −1.56 | −0.53 | 1.64 | −0.32 | −1.26 | 1.62 | −0.78 | −2.49 | 1.65 |
| 4000 | −1.40 | 1.34 | −1.05 | −0.83 | 1.35 | −0.61 | −0.70 | 1.33 | −0.53 | −2.43 | 1.36 |

TABLE 8-continued

| Occlusion Effect Comparisons | | | | | | | | | | | |
|---|---|---|---|---|---|---|---|---|---|---|---|
| frequency | V vs None est | SE | t-value | 1 vs None est | SE | t-values | 2 vs None est | SE | t-value | 3 vs None est | SE |
| 4100 | −0.90 | 1.35 | −0.66 | −0.76 | 1.36 | −0.56 | −0.93 | 1.35 | −0.69 | −2.45 | 1.37 |
| 4200 | −0.31 | 1.39 | −0.22 | −0.65 | 1.40 | −0.46 | −0.98 | 1.38 | −0.71 | −2.02 | 1.40 |
| 4300 | 0.13 | 1.47 | 0.09 | −0.84 | 1.48 | −0.57 | −1.18 | 1.46 | −0.81 | −2.36 | 1.48 |
| 4400 | 0.34 | 1.48 | 0.23 | −1.14 | 1.49 | −0.77 | −1.70 | 1.47 | −1.16 | −2.30 | 1.49 |
| 4500 | 0.01 | 1.54 | 0.01 | −1.34 | 1.55 | −0.86 | −1.64 | 1.53 | −1.07 | −1.13 | 1.56 |
| 4600 | −0.42 | 1.48 | −0.28 | −1.64 | 1.49 | −1.10 | −2.14 | 1.47 | −1.46 | −1.93 | 1.50 |
| 4700 | −0.44 | 1.31 | −0.34 | −1.46 | 1.31 | −1.11 | −2.30 | 1.30 | −1.78 | −1.88 | 1.32 |
| 4800 | 0.02 | 1.28 | 0.01 | −1.49 | 1.29 | −1.15 | −2.18 | 1.28 | −1.71 | −1.74 | 1.30 |

TABLE 9 provides estimates and standard errors of the Perceived Occlusion Effect for hearing devices evaluated by Group A. TABLE 9 also provides comparisons of each non-Vivatone Group A device to the Vivatone device. Positive values indicate that the Perceived Occlusion Effect was greater for the non-Vivatone device. T-values equal to or greater than 2.47 are statistically significant (adjusting for multiple comparisons). TABLE 9 follows:

TABLE 9

| Perceived Occlusion Effect | | | | | | | |
|---|---|---|---|---|---|---|---|
| G: est | SE | O: est | SE | S: est | SE | V: est | SE |
| 1.23 | 0.13 | 2.68 | 0.13 | 3.45 | 0.13 | 0.14 | 0.13 |

| Perceived Occlusion Effect Comparions | | | | | | | | |
|---|---|---|---|---|---|---|---|---|
| G vs V: est | SE | t-value | O vs V: est | SE | t-value | S vs V: est | SE | t-value |
| 1.09 | 0.18 | 5.99 | 2.55 | 0.18 | 13.99 | 3.32 | 0.18 | 18.23 |

TABLE 10 provides estimates and standard errors of the Perceived Occlusion Effect for hearing devices evaluated by Group B. TABLE 10 also provides comparisons of each Vivatone Group B device condition to the None condition. Positive values indicate that the Perceived Occlusion Effect was greater for the Vivatone device condition. T-values equal to or greater than 2.59 are statistically significant (adjusting for multiple comparisons). TABLE 10 follows:

TABLE 11 provides estimates of the correlation between the Occlusion Effect and the Perceived Occlusion Effect for Group A. The correlation is computed after adjusting for subject effects. A separate correlation is computed for the Occlusion Effect at each measured frequency and the Perceived Occlusion Effect. P-values are given for each correlation value to assess statistical significance. TABLE 11 follows:

TABLE 11

| Correlation between Objective and Subjective (adjusted for subject differences) | | |
|---|---|---|
| Group A frequency | correlation | p-value |
| 200 | 0.7225 | 0.0000 |
| 300 | 0.7873 | 0.0000 |
| 400 | 0.8346 | 0.0000 |
| 500 | 0.8348 | 0.0000 |
| 600 | 0.8598 | 0.0000 |
| 700 | 0.8964 | 0.0000 |
| 800 | 0.8829 | 0.0000 |
| 900 | 0.7974 | 0.0000 |
| 1000 | 0.6870 | 0.0000 |
| 1100 | 0.5309 | 0.0012 |
| 1200 | 0.4302 | 0.0111 |
| 1300 | 0.3566 | 0.0384 |
| 1400 | 0.3028 | 0.0817 |
| 1500 | 0.2483 | 0.1568 |
| 1600 | 0.0480 | 0.7877 |
| 1700 | −0.0711 | 0.6894 |
| 1800 | −0.1994 | 0.2582 |

TABLE 10

| Perceived Occlusion Effect | | | | | | | | | | | |
|---|---|---|---|---|---|---|---|---|---|---|---|
| None: est | SE | V: est | SE | 1: est | SE | 2: est | SE | 3: est | SE | 4: est | SE |
| 0.14 | 0.15 | 0.27 | 0.15 | 0.73 | 0.15 | 1.05 | 0.15 | 123 | 0.15 | 1.59 | 0.15 |

| Perceived Occlusion Effect Comparions | | | | | | | | | | | |
|---|---|---|---|---|---|---|---|---|---|---|---|
| V vs None est | SE | t-value | 1 vs None est | SE | t-value | 2 vs None est | SE | t-value | 3 vs None est | SE | t-value |
| 0.14 | 0.22 | 0.63 | 0.59 | 0.22 | 2.74 | 0.91 | 0.22 | 4.21 | 1.09 | 0.22 | 5.05 |

TABLE 11-continued

| Correlation between Objective and Subjective (adjusted for subject differences) | | |
|---|---|---|
| Group A frequency | correlation | p-value |
| 1900 | −0.3013 | 0.0834 |
| 2000 | −0.5101 | 0.0021 |
| 2100 | −0.6106 | 0.0001 |
| 2200 | −0.6659 | 0.0000 |
| 2300 | −0.7659 | 0.0000 |
| 2400 | −0.7764 | 0.0000 |
| 2500 | −0.7953 | 0.0000 |
| 2600 | −0.8618 | 0.0000 |
| 2700 | −0.8636 | 0.0000 |
| 2800 | −0.8489 | 0.0000 |
| 2900 | −0.8753 | 0.0000 |
| 3000 | −0.8387 | 0.0000 |
| 3100 | −0.8090 | 0.0000 |
| 3200 | −0.7997 | 0.0000 |
| 3300 | −0.8016 | 0.0000 |
| 3400 | −0.8104 | 0.0000 |
| 3500 | −0.7738 | 0.0000 |
| 3600 | −0.7654 | 0.0000 |
| 3700 | −0.8076 | 0.0000 |
| 3800 | −0.7877 | 0.0000 |
| 3900 | −0.7549 | 0.0000 |
| 4000 | −0.7424 | 0.0000 |
| 4100 | −0.6608 | 0.0000 |
| 4200 | −0.5726 | 0.0004 |
| 4300 | −0.5453 | 0.0009 |
| 4400 | −0.4746 | 0.0046 |
| 4500 | −0.3562 | 0.0387 |
| 4600 | −0.2666 | 0.1274 |

TABLE 12 provides estimates of the correlation between the Occlusion Effect and the Perceived Occlusion Effect for Group B. The correlation is computed after adjusting for subject effects. A separate correlation is computed for the Occlusion Effect at each measured frequency and the Perceived Occlusion Effect. P-values are given for each correlation value to assess statistical significance. TABLE 12 follows:

TABLE 12

| Correlation between Objective and Subjective (adjusted for subject differences) | | |
|---|---|---|
| Group B frequency | correlation | p-value |
| 200 | 0.1156 | 0.3963 |
| 300 | 0.1106 | 0.4173 |
| 400 | 0.1665 | 0.2200 |
| 500 | 0.2099 | 0.1205 |
| 600 | 0.2945 | 0.0276 |
| 700 | 0.3116 | 0.0194 |
| 800 | 0.2751 | 0.0401 |
| 900 | 0.3876 | 0.0032 |
| 1000 | 0.3618 | 0.0062 |
| 1100 | 0.3942 | 0.0026 |
| 1200 | 0.3374 | 0.0110 |
| 1300 | 0.3861 | 0.0033 |
| 1400 | 0.3905 | 0.0029 |
| 1500 | 0.3904 | 0.0029 |
| 1600 | 0.4011 | 0.0022 |
| 1700 | 0.4743 | 0.0002 |
| 1800 | 0.3645 | 0.0057 |
| 1900 | 0.3028 | 0.0233 |
| 2000 | 0.1392 | 0.3062 |
| 2100 | −0.0602 | 0.6593 |
| 2200 | −0.2710 | 0.0434 |
| 2300 | −0.4309 | 0.0009 |
| 2400 | −0.5320 | 0.0000 |

TABLE 12-continued

| Correlation between Objective and Subjective (adjusted for subject differences) | | |
|---|---|---|
| Group B frequency | correlation | p-value |
| 2500 | −0.5335 | 0.0000 |
| 2600 | −0.5898 | 0.0000 |
| 2700 | −0.5985 | 0.0000 |
| 2800 | −0.6579 | 0.0000 |
| 2900 | −0.5788 | 0.0000 |
| 3000 | −0.5580 | 0.0000 |
| 3100 | −0.5627 | 0.0000 |
| 3200 | −0.5354 | 0.0000 |
| 3300 | −0.4781 | 0.0002 |
| 3400 | −0.3973 | 0.0024 |
| 3500 | −0.3848 | 0.0034 |
| 3600 | −0.3769 | 0.0042 |
| 3700 | −0.3795 | 0.0039 |
| 3800 | −0.3432 | 0.0096 |
| 3900 | −0.3263 | 0.0141 |
| 4000 | −0.4201 | 0.0013 |
| 4100 | −0.4806 | 0.0002 |
| 4200 | −0.4914 | 0.0001 |
| 4300 | −0.5041 | 0.0001 |
| 4400 | −0.5042 | 0.0001 |
| 4500 | −0.4386 | 0.0007 |
| 4600 | −0.4923 | 0.0001 |

With reference to TABLE 1, the following interpretive summary of data across the tested frequencies might apply with regard to loss of the natural resonance of the ear (frequencies largely between 1500 Hz and 5000 Hz; see Shaw EAG. Transformation of sound pressure from the free field to the eardrum in the horizontal plane. Journal of the Acoustical Society of America 56: 1848-1861, 1974.) due to insertion loss: GHI has about −9 to −10 dB of insertion loss; Oticon has about −20 dB of insertion loss; Sebotek has about −20 to −29 dB of insertion loss; and Vivatone has about −0 to −2 dB of insertion loss (standard error is about 0.75).

Thus, it is evident from the data of TABLE 1 that positioning a Vivatone hearing aid into the ear changes the natural hearing (REUR) almost none. The numbers for the Vivatone are near 0 (zero) from 200-2600 Hz and approximate 2 dB in the higher frequencies. It is likely that from a clinical point of view, a Vivatone hearing aid user would not notice a 2 dB change. If such is the case, then the data shows that the Vivatone device does not make an appreciable change in open ear hearing and is, therefore, transparent to the sounds entering an ear canal. In contrast, all the other tested hearing aids make substantial reductions (It should be noted that if a user is presented a high frequency sound like "tch, tch, tch" at a moderate level, and if only a 6 dB change in intensity is made, the user will easily notice the changes, since a 6 dB change in intensity results in doubling loudness perception from a psychoacoustics point of view.

According to the data in TABLE 1, the least occlusion loss (outside of Vivatone) was present with the GHI device, which causes a loss in the 9-10 dB range in the high frequencies. The Oticon instrument was responsible for as much as a 20 dB change and the Seboteck instrument resulted in a 20-29 dB change. For example, a change of 20-30 dB in high frequency is so substantial that inserting fingers into ears and blocking off the ear canals produces a decrease in the high frequencies of about 30 dB. A 30 dB change produces a 10-fold change in loudness from the loudness perception point of view.

With reference to TABLE 3, the following interpretive summary of data across the most relevant frequencies (about 200 Hz to about 1000 Hz) might apply with regard to the Occlusion Effect (that is, change in the sound pressure level of the voiced sound "ee" resultant from inserting a hearing aid into the ear, measured in the ear canal between a turned-off hearing aid and the eardrum: GHI has about +8 to 10 dB of Occlusion Effect; Oticon has about +12 to 16 dB of Occlusion Effect; Sebotek has about +20 to 22 dB of Occlusion Effect; and Vivatone has about +2 dB of Occlusion Effect (with 1.61 SE value).

Thus, it is evident from the data of TABLE 3 that positioning the tested exemplary Vivatone receiver unit into the ear causes the patient's voice level (from a voiced sound "ee") to change no more than about 2 dB. As discussed above, a 2 dB change might be considered clinically insignificant and unnoticeable, while increases of more than 6 dB might be considered very annoying and very evident to the user.

According to the data in TABLE 3, the second instrument with least occlusion effect is GHI, which causes an occlusion effect in the 8-10 dB range. The Oticon instrument produced 12 to 16 dB of Occlusion Effect and the Seboteck instrument resulted in 20 to 22 dB of Occlusion Effect.

This is supported in TABLE 9, which provides the subjective data gathered from test patients with regard to perceived Occlusion Effect. Review of TABLE 9 shows that the Vivatone device has a rating near 0 (zero), the GHI device has a rating of 1.23, the Oticon device has a rating of 2.68, and the Sebotek device has a rating of 3.32.

With reference to TABLE 5, the following interpretive summary of data across the tested relevant frequencies might apply with regard to the correlation between insertion loss and the size of the receiver unit in the presently described open ear configuration. A casual assessment of the data from TABLE 5 reveals: None (with nothing in the ear canal), 0 dB of insertion loss; the Vivatone receiver unit tested for Group A (with Ø=0.149 inches), no more than about 2 dB of insertion loss; with Ø=0.170 inch receiver unit, no more than about 2.2 dB of insertion loss; with Ø=0.190 inch receiver unit, no more than about 4 dB of insertion loss; and with Ø=0.210 inch receiver unit, no more than about 5.7 dB of insertion loss. It should be noted that alternate mathematical mechanisms may be used for describing the size of the receiver placed in the acoustically open ear canal. While cross sectional lateral dimensions (e.g. Ø) may be used, cross sectional receiver areas or the like might also be used, where an exemplary tubular receiver cross section corresponding to 0.149 inches would equate to a lateral cross sectional area of about 0.0177 inches squared, etc.

While exemplary embodiments have been shown and described, various modifications and substitutions may be made thereto without departing from the spirit and scope of the invention. Accordingly, it is to be understood that the present invention has been described by way of illustration and not limitation.

What is claimed is:

1. A hearing aid, comprising:

a microphone sampling position and amplifier located on the external of a user; and a receiver, comprising a speaker housed within a casing, positionable in an acoustically open-ear configuration and suspended within the ear canal wherein sound from the microphone sampling position is amplified in accordance with hearing loss programming and passed via electrical connection from a portion of the external ear and through the ear canal opening of that ear to the speaker that is positioned within the ear canal in an acoustically open ear configuration, which configuration lacks additional substantially obstructive masses in the open canal adjacent said casing, and wherein such receiver has a lateral cross sectional area of about 0.0415 inches squared or below and is dimensioned so as to generate about eight decibels or below of insertion loss and about eight decibels or below of occlusion effect over human audible frequencies.

2. A hearing aid in accordance with claim 1, wherein the receiver is configured to be positioned at least partially within the cartilaginous region of a user's ear canal, the receiver dimensioned so as to minimize insertion loss upon positioning of the receiver within the cartilaginous region.

3. A hearing aid in accordance with claim 1, wherein the receiver generates about eight decibels or below of insertion loss over audible frequencies between about 2200 Hz and about 5300 Hz.

4. A hearing aid according to claim 1, wherein the receiver generates about eight decibels or below of insertion loss over audible frequencies between about 3000 Hz and about 5000 Hz.

5. A hearing aid according to claim 1, wherein the receiver generates about eight decibels or below of insertion loss over audible frequencies between about 3500 Hz and about 4500 Hz.

6. A hearing aid according to claim 1, wherein the receiver generates about six and a half decibels or below of insertion loss over audible frequencies between about 3500 Hz and about 4500 Hz.

7. A hearing aid according to claim 1, wherein the receiver has a maximum lateral dimension that is less than the maximum lateral dimension of a user's ear canal.

8. A hearing aid in accordance with claim 1, wherein such receiver casing has a lateral cross sectional area of about 0.0346 inches squared or below and is dimensioned so as to generate about six decibels or below of insertion loss and about six and a half decibels or below of occlusion effect over human audible frequencies.

9. A hearing aid in accordance with claim 8, wherein the receiver generates about six decibels or below of insertion loss over audible frequencies between about 2200 Hz and about 5300 Hz.

10. A hearing aid according to claim 8, wherein the receiver generates about six decibels or below of insertion loss over audible frequencies between about 3000 Hz and about 5000 Hz.

11. A hearing aid in accordance with claim 1, wherein such receiver casing has a lateral cross sectional area of about 0.0284 inches squared or below and is dimensioned so as to generate about four and a half decibels or below of insertion loss and about five and a quarter decibels or below of occlusion effect over human audible frequencies.

12. A hearing aid according to claim 11, wherein the receiver generates about four decibels or below of insertion loss over audible frequencies between about 3500 Hz and about 4500 Hz.

13. A hearing aid in accordance with claim 11, wherein the receiver generates about four and a half decibels or below of insertion loss over audible frequencies between about 2200 Hz and about 5300 Hz.

14. A hearing aid according to claim 11, wherein the receiver generates about four and a half decibels or below of insertion loss over audible frequencies between about 3000 Hz and about 5000 Hz.

15. A hearing aid in accordance with claim 11, wherein the receiver generates about four and a half decibels or below of occlusion effect between about 200 Hz and about 2600 Hz.

16. A hearing aid in accordance with claim 11, wherein the receiver generates about four decibels or below of occlusion effect between about 200 Hz and about 2000 Hz.

17. A hearing aid in accordance with claim 11, wherein the receiver generates about three and a half decibels or below of occlusion effect between about 200 Hz and about 2000 Hz.

18. A hearing aid in accordance with claim 11, wherein the receiver generates about four decibels or below of occlusion effect between about 800 Hz and about 1500 Hz.

19. A hearing aid in accordance with claim 11, wherein the receiver generates about four decibels or below of occlusion effect between about 200 Hz and about 1000 Hz.

20. A hearing aid in accordance with claim 11, wherein the receiver generates about three and a half decibels or below of occlusion effect between about 200 Hz and about 1000 Hz.

21. A hearing aid in accordance with claim 11, wherein the receiver generates about four decibels or below of occlusion effect between about 1500 Hz and about 2000 Hz.

22. A hearing aid in accordance with claim 1, wherein such receiver casing has a lateral cross sectional area of about 0.0227 inches squared or below and is dimensioned so as to generate about three decibels or below of insertion loss and about four decibels or below of occlusion effect over human audible frequencies.

23. A hearing aid in accordance with claim 22, wherein the receiver generates about three decibels or below of insertion loss over audible frequencies between about 2200 Hz and about 5300 Hz.

24. A hearing aid according to claim 22, wherein the receiver generates about two and a half decibels or below of insertion loss over audible frequencies between about 3000 Hz and about 5000 Hz.

25. A hearing aid according to claim 22, wherein the receiver generates about three decibels or below of insertion loss over audible frequencies between about 3500 Hz and about 4500 Hz.

26. A hearing aid in accordance with claim 22, wherein the receiver generates about two and a half decibels or below of occlusion effect between about 800 Hz and about 1500 Hz.

27. A hearing aid in accordance with claim 1, wherein such receiver casing has a lateral cross sectional area of about 0.0177 inches squared or below and is dimensioned so as to generate about three decibels or below of insertion loss and about three and a half decibels or below of occlusion effect over human audible frequencies.

28. A hearing aid in accordance with claim 27, wherein the receiver generates about two decibels or below of occlusion effect between about 200 Hz and about 2600 Hz.

29. A hearing aid in accordance with claim 27, wherein the receiver generates about two decibels or below of occlusion effect between about 1500 Hz and about 2000 Hz.

30. A hearing aid according to claim 1, wherein a retaining member extends from at least one of an intermediate connecting portion containing said electrical connection and the receiver, and further wherein the retaining member is configured to engage at least a portion of the concha of a user's ear.

31. A hearing aid according to claim 30, wherein the retaining member is configured such that the receiver has a maximum insertion depth into an ear canal.

32. The hearing aid according to claim 30, wherein the retaining member is configured such that the receiver does not substantially contact any portion of an ear canal when inserted within the ear canal.

33. A hearing aid according to claim 30, wherein the retaining member stabilizes the receiver in the ear canal.

34. A hearing aid according to claim 30, wherein the retaining member prevents substantial movement of the receiver in the ear canal.

35. A hearing aid according to claim 1, wherein the receiver has first and second end portions, the first end portion communicating with an intermediate connecting portion containing said electrical connection, the speaker communicating with a port provided at the second end portion.

36. A hearing aid according to claim 35, wherein the port is at least partially sealed to foreign matter by a membrane or mesh material.

37. A hearing aid according to claim 36, wherein the casing is sealed to foreign matter at the first end portion and along a length of the receiver extending from the first end portion to the port.

38. A hearing aid according to claim 35, wherein the port includes a removable cerumen collector.

39. A hearing aid in accordance with claim 1, wherein the receiver generates about eight decibels or below of occlusion effect between about 200 Hz and about 2600 Hz.

40. A hearing aid in accordance with claim 1, wherein the receiver generates about six and a quarter decibels or below of occlusion effect between about 200 Hz and about 2600 Hz.

41. A hearing aid in accordance with claim 1, wherein the receiver generates about eight decibels or below of occlusion effect between about 200 Hz and about 2000 Hz.

42. A hearing aid in accordance with claim 1, wherein the receiver generates about six decibels or below of occlusion effect between about 200 Hz and about 2000 Hz.

43. A hearing aid in accordance with claim 1, wherein the receiver generates about eight decibels or below of occlusion effect between about 800 Hz and about 1500 Hz.

44. A hearing aid in accordance with claim 1, wherein the receiver generates about six decibels or below of occlusion effect between about 800 Hz and about 1500 Hz.

45. A hearing aid in accordance with claim 1, wherein the receiver generates about eight decibels or below of occlusion effect between about 200 Hz and about 1000 Hz.

46. A hearing aid in accordance with claim 1, wherein the receiver generates about six decibels or below of occlusion effect between about 200 Hz and about 1000 Hz.

47. A hearing aid in accordance with claim 1, wherein the receiver generates about eight decibels or below of occlusion effect between about 1500 Hz and about 2000 Hz.

48. A hearing aid in accordance with claim 1, wherein the receiver generates about six decibels or below of occlusion effect between about 1500 Hz and about 2000 Hz.

49. A hearing aid in accordance with claim 1 wherein said positioning of said receiver is facilitated by one or both of a stiffening device provided at least partially in or on an intermediate connecting portion containing said electrical connection and a supported surface provided on the receiver and/or the intermediate connecting portion, the supported surface configured to distance the receiver from a portion of the user's ear canal.

50. The hearing aid of claim 49, wherein said stiffening device is a stiffening wire.

51. The hearing aid according to claim 50, wherein the stiffening wire comprises a metal or alloy of metals or plastic material.

52. The hearing aid according to claim 50, wherein the stiffening wire comprises a plastic material having heat deformable properties.

53. The hearing aid according to claim 51, wherein the metal or alloy of metals has memory such that the wire may deflect and return to an original orientation.

54. The hearing aid according to claim 50, wherein the intermediate connecting portion comprises an electrical conducting component, wherein the electrical conducting portion is provided at least partially within a first channel, and wherein the stiffening wire is provided external to the first channel.

55. The hearing aid according to claim 54, wherein the stiffening wire is provided within a second channel.

56. The hearing aid according to claim 50, wherein the stiffening wire extends within or on at least a portion of the receiver.

57. The hearing aid of claim 49, wherein said stiffening device is a stiffening tube provided at least partially around or within a portion of said intermediate connecting portion.

58. The hearing aid of claim 57, wherein said stiffening tube is provided at a receiver end portion of the intermediate connecting portion.

59. The hearing aid of claim 58, wherein said stiffening tube comprises a metal or alloy of metals.

60. The hearing aid of claim 59, wherein said stiffening tube comprises a goose neck tube.

61. The hearing aid of claim 49, wherein said stiffening device is a stiffening wire provided at least partially on or within a portion of said intermediate connecting portion, and further wherein said stiffening wire extends from a portion of the intermediate connecting portion or a portion of the receiver to contact a portion of the user's external ear.

62. The hearing aid of claim 49, wherein a retaining member extends from at least one of the intermediate connecting portion and the receiver, wherein the retaining member is configured to engage at least a portion of the concha of a user's ear, and wherein the retaining member extends from a portion of the stiffening device.

63. The hearing aid of claim 49, wherein said supported surface comprises a spring material, attached to the receiver or the intermediate connecting portion, wherein said spring has a portion having a rest position at a distance γ from the receiver.

64. The hearing aid of claim 49, wherein said supported surface is distanced from the receiver by at least one support.

65. The hearing aid of claim 64, wherein said support comprises a spring material.

66. The hearing aid of claim 64, wherein said supported surface is distanced from the receiver by a plurality of supports.

67. The hearing aid of claim 64, wherein said supported surface is a curved surface provided at least partially around the receiver.

68. The hearing aid of claim 67, wherein said supported surface is generally ring shaped, and wherein said at least one support and said supported surface define at least one aperture between the receiver and the supported surface.

69. The hearing aid of claim 64, wherein said supported surface is at least one fin provided on a portion of said receiver.

70. The hearing aid of claim 69, wherein said supported surface is a plurality of fins provided at least partially around said receiver.

71. The hearing aid of claim 64, wherein said supported surface is at least one fin configured to engage the tragus of a user when the receiver is positioned within a user's ear canal.

72. The hearing aid of claim 71, wherein said fin is provided on a spring material, which spring material is connected to either the receiver or the intermediate connecting portion.

73. The hearing aid of claim 49, wherein the supported surface is at least one porous material provided on at least a portion the receiver.

74. The hearing aid of claim 73, wherein the supported surface is a porous material provided around the receiver.

75. The hearing aid of claim 74, wherein said porous material is disc shaped.

76. The hearing aid of claim 74, wherein said porous material is configured to attenuate sounds coming into and escaping from a user's ear canal to reduce feedback or to alter the amount of sound reaching a user's eardrum.

77. The hearing aid of claim 74, wherein said porous material comprises one of a paper tissue, a Teflon coated fiber, a perforated silicone, and a membrane.

78. The hearing aid of claim 49, wherein the supported surface is configured to move away from or move towards the receiver to adjust a distance γ from the receiver to a desired distance.

79. The hearing aid of claim 78, wherein said supported surface is attached to the receiver at a first end, and wherein a second end may be translated longitudinally with respect to the receiver to move the supported surface away from or towards the receiver.

80. A hearing aid, comprising:

a microphone sampling position and amplifier located on the external ear of a user;

a receiver, comprising a speaker housed within a casing, positionable in an acoustically open-ear configuration and suspended within the ear canal by a ring of material having a plurality of supports, wherein sound from the microphone sampling position is amplified in accordance with hearing loss programming and passed via electrical connection from a portion of the external ear and through the ear canal opening of said ear to the speaker that is positioned within the ear canal in an open ear configuration, which configuration lacks additional substantially obstructive masses in the open canal adjacent said casing, and wherein such receiver has a lateral cross sectional area of about 0.0415 inches squared or below and is dimensioned so as to generate about eight decibels or below of insertion loss and about eight decibels or below of occlusion effect over human audible frequencies.

81. A hearing aid in accordance with claim 80, wherein said supports extend between the ring of material and the receiver, and wherein the ring and the supports define a plurality of apertures between the receiver and the ring of material.

82. A hearing aid in accordance with claim 80, wherein the ring of material is deformable.

83. A hearing aid in accordance with claim 80, wherein the ring of material is generally transparent to low frequency human hearing range sounds.

84. A hearing aid in accordance with claim 80, wherein the plurality of supports have consistent thickness along a length between the receiver and the ring of material.

85. A hearing aid in accordance with claim 80, wherein the plurality of supports have different shapes at different points between the receiver and the ring of material.

86. A hearing aid in accordance with claim 80, comprising four supports attached to the ring of material.

87. A hearing aid in accordance with claim 86, wherein four apertures are defined between the ring of material and the receiver.

88. A hearing aid in accordance with claim 80, wherein the plurality of supports are deformable.

89. A hearing aid in accordance with claim 88, wherein the plurality of supports is generally transparent to low frequency human hearing range sounds.

* * * * *